US008390543B2

(12) United States Patent
Iida et al.

(10) Patent No.: US 8,390,543 B2
(45) **Date of Patent: *Mar. 5, 2013**

(54) DISPLAY DEVICE, DRIVING METHOD THEREOF, AND ELECTRONIC APPARATUS

(75) Inventors: Yukihito Iida, Kanagawa (JP); Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 692 days.

This patent is subject to a terminal disclaimer.

(21) Appl. No.: 11/826,875

(22) Filed: Jul. 19, 2007

(65) Prior Publication Data

US 2008/0238830 A1 Oct. 2, 2008

(30) Foreign Application Priority Data

Jul. 27, 2006 (JP) ..... P2006-204057

(51) Int. Cl.
*G09G 3/30* (2006.01)
*G09G 3/10* (2006.01)

(52) U.S. Cl. ..... 345/77; 315/169.1

(58) Field of Classification Search ..... 345/76, 345/77; 315/169.1

See application file for complete search history.

(56) References Cited

U.S. PATENT DOCUMENTS

| | | | | |
|---|---|---|---|---|
| 7,045,821 | B2 * | 5/2006 | Shih et al. | 257/88 |
| 7,071,932 | B2 * | 7/2006 | Libsch et al. | 345/82 |
| 7,109,952 | B2 * | 9/2006 | Kwon | 345/76 |
| 7,274,345 | B2 * | 9/2007 | Imamura et al. | 345/76 |
| 7,324,101 | B2 * | 1/2008 | Miyazawa | 345/211 |
| 7,808,455 | B2 * | 10/2010 | Ono | 345/76 |
| 8,072,399 | B2 * | 12/2011 | Iida et al. | 345/76 |
| 2004/0001037 | A1 * | 1/2004 | Tsujimura et al. | 345/76 |
| 2005/0206590 | A1 * | 9/2005 | Sasaki et al. | 345/76 |
| 2005/0269959 | A1 * | 12/2005 | Uchino et al. | 315/169.3 |
| 2005/0280614 | A1 * | 12/2005 | Goh | 345/76 |
| 2006/0077138 | A1 * | 4/2006 | Kim | 345/76 |
| 2007/0046592 | A1 * | 3/2007 | Ono et al. | 345/77 |

FOREIGN PATENT DOCUMENTS

| | | |
|---|---|---|
| JP | 2003-173154 A | 6/2003 |
| JP | 2003-228324 A | 8/2003 |
| JP | 2003-255856 | 9/2003 |
| JP | 2003-263129 A | 9/2003 |
| JP | 2003-271095 | 9/2003 |
| JP | 2004-029791 | 1/2004 |
| JP | 2004-093682 | 3/2004 |

(Continued)

OTHER PUBLICATIONS

Japanese Office Action issued Nov. 1, 2011 for corresponding Japanese Application No. 2006-204057.

*Primary Examiner* — Adam J Snyder
(74) *Attorney, Agent, or Firm* — Rader, Fishman & Grauer PLLC

(57) ABSTRACT

A display device includes pixel array unit and a driver unit. A sampling transistor samples a signal potential to hold the signal potential in a holding capacitor. A driver transistor flows a drive current to a light emitting element in accordance with the signal potential held. A main scanner in the driver unit outputs the control signal having a shorter pulse width than the time period to the scan line to make the sampling transistor conductive during a time period while the signal line is at the signal potential, thereby adding the signal potential a correction for a mobility of the driver transistor when the signal potential is held in the holding capacitor.

12 Claims, 29 Drawing Sheets

FOREIGN PATENT DOCUMENTS

| | | | |
|---|---|---|---|
| JP | 2004-133240 | | 4/2004 |
| JP | 2004-295131 | A | 10/2004 |
| JP | 2005-004173 | A | 1/2005 |
| WO | WO 2005114629 | A1 * | 12/2005 |

* cited by examiner

DISPLAY DEVICE, DRIVING METHOD THEREOF, AND ELECTRONIC APPARATUS

BACKGROUND OF THE INVENTION

1. Field of the Invention

The present invention relates to an active matrix type display device using light emitting elements as pixels and a driving method thereof. The present invention relates also to an electronic apparatus in which the display device of this type is assembled.

2. Description of Related Art

The development of emissive flat panel display devices using an organic electroluminescent (EL) device as an optical emitting element has been made vigorously in recent years. An organic EL device is a device utilizing a phenomenon that as an electric field is applied to an organic thin film, light emission occurs. Since the organic EL device is driven by an application voltage of 10 V or lower, the device consumes a low power. Since the organic EL device is an emissive device which emits light by itself, no illumination member is required and the device can be made easily light in weight and thin. Furthermore, a response time of the organic EL device is very fast at about several μs, so that an afterimage does not occur during displaying moving images.

Among flat panel emissive type display devices using organic EL devices as pixels, active matrix type display devices integrating a thin film transistor in each pixel have been developed vigorously. Active matrix type flat panel emissive display devices are described, for example, in the following Patent Documents 1 to 5.

Japanese Patent Application Publication No. 2003-255856 (Patent Document 1)

Japanese Patent Application Publication No. 2003-271095 (Patent Document 2)

Japanese Patent Application Publication No. 2004-133240 (Patent Document 3)

Japanese Patent Application Publication No. 2004-029791 (Patent Document 4)

Japanese Patent Application Publication No. 2004-093682 (Patent Document 5)

SUMMARY OF THE INVENTION

However, current-technology active matrix type flat panel emissive display devices have a variation in threshold voltages and mobilities of transistors for driving light emitting elements due to process variations. The characteristics of an organic EL device are subject to a secular change. A variation in the characteristics of driver transistors and a change in the characteristics of organic EL devices affect an emission luminance. In order to control an emission luminance uniformly over the whole screen of a display device, a change in the characteristics of transistors and organic EL device are required to be corrected in each pixel circuit. A display device provided with a correction function has been proposed. However, the proposed pixel circuit provided with the correction function requires switching transistors and switching pulses, resulting in a complicated pixel circuit. Since there are many constituent elements of a pixel circuit, these elements hinder high precision of a display.

The present invention is made in view of the above-described problems associated with the technologies. One advantage of the present invention is that there is provided a display device capable of realizing high precision of the device by simplifying a pixel circuit and its driving method. Specifically, an improved display device and driving method thereof is provided, which is capable of reliably performing a video signal sampling operation and a correction function, irrespective of a transmission delay and a waveform deterioration of a control signal and a video signal to be caused by wiring capacitance and resistance. According to an embodiment of the present invention, there is provided a display device including basically a pixel array unit and a driver unit for driving the pixel array unit. The pixel array unit includes row scan lines, column signal lines, pixels disposed in a matrix shape at cross points between the scan lines and the signal lines, and power supply lines disposed in correspondence of rows of the pixels. The driver unit includes a main scanner for supplying a sequential control signal to each of the scan lines to perform line sequential scanning of the pixels in a row unit, a power supply scanner for supplying, synchronously with the line sequential scanning, a power supply voltage switching between first and second potentials to each of the power supply lines, and a signal selector for supplying, synchronously with the line sequential scanning, a signal potential as a video signal, and a reference potential to each of the column signal lines. Each of the pixels includes a light emitting element, a sampling transistor, a driver transistor and a holding capacitor. The sampling transistor has a gate connected to the scan line, one of a source and a drain connected to the signal line, and the other connected to a gate of the driver transistor, the driver transistor has one of a source and a drain connected to the light emitting element, and the other connected to the power supply lines, and the holding capacitor is connected across the source and a gate of the driver transistor. The sampling transistor becomes conductive in response to a control signal supplied from the scan line, and samples a signal potential supplied from the signal line to hold the sampled signal potential in the holding capacitor. The driver transistor receives a supply of a current from the power supply line at the first potential and flows a drive current to the light emitting element in accordance with the held signal potential. In order to make the sampling transistor conductive during a time period while the signal line is at the signal potential, the main scanner outputs the control signal having a shorter pulse width than the time period to the scan line to thereby add to the signal potential a correction for a mobility of the driver transistor when the signal potential is held in the holding capacitor.

Preferably, the main scanner makes the sampling transistor non-conductive when the signal potential is held in the holding capacitor to electrically disconnect the signal line from the gate of the driver transistor, to thereby make a gate potential of the driver transistor follow a variation in a source potential and maintain a gate-source voltage constant. Furthermore, the power supply scanner may change the power supply line from the first potential to the second potential at a first timing before the sampling transistor samples the signal potential, the main scanner may make the sampling transistor conductive at a second timing before the sampling transistor samples the signal potential to apply the reference potential from the signal line to the gate of the driver transistor and set the source of the driver transistor to the second potential, and then the power supply scanner may change the power supply line from the second potential to the first potential at a third timing after the second timing to hold a voltage corresponding to a threshold voltage of the driver transistor in the holding capacitor.

In an embodiment of the present invention, an active matrix type display device using, as pixels, light emitting elements such as organic EL devices, each pixel has a mobility correction function of the driver transistor. Preferably, each pixel has also a threshold voltage correction function of the driver transistor, a secular variation correction function (bootstrap operation) of an organic EL device and other functions, to obtain a high image quality. A current-technology pixel circuit having the correction functions of this type has a large layout area because of a number of constituent elements so that the pixel circuit is not suitable for high precision of the display. According to an embodiment of the present invention, the power supply voltage is subject to switching, to thereby reduce the number of constituent elements and allow the layout area of pixels to be reduced. Accordingly, a high fidelity and high precision flat display can be provided.

According to an embodiment of the present invention, in order to make the sampling transistor conductive during a time period while the signal line is at the signal potential, a control signal having a shorter pulse width than the time period may be outputted to the scan line to thereby add to the signal potential a correction for a mobility of the driver transistor when the signal potential is held in the holding capacitor. In other words, the control signal pulse for making the sampling transistor conductive is included essentially in the time period while the video signal line is at the signal potential. With this arrangement, even if there is a transmission delay or waveform deterioration of the control signal pulse or video signal waveform because of the wiring capacitance and resistance, it is possible to perform the sampling operation for holding the video signal in the holding capacitor and the corresponding mobility correction operation of the driver transistor. Even if there is a variation in control signal pulses in the screen constituted of pixels, a variation in sampled signal potentials can be reduced, and an occurrence of irregular luminance can be avoided Thus, a display device of a good image quality can be provided.

DETAILED DESCRIPTION OF EMBODIMENTS

Figure 1:
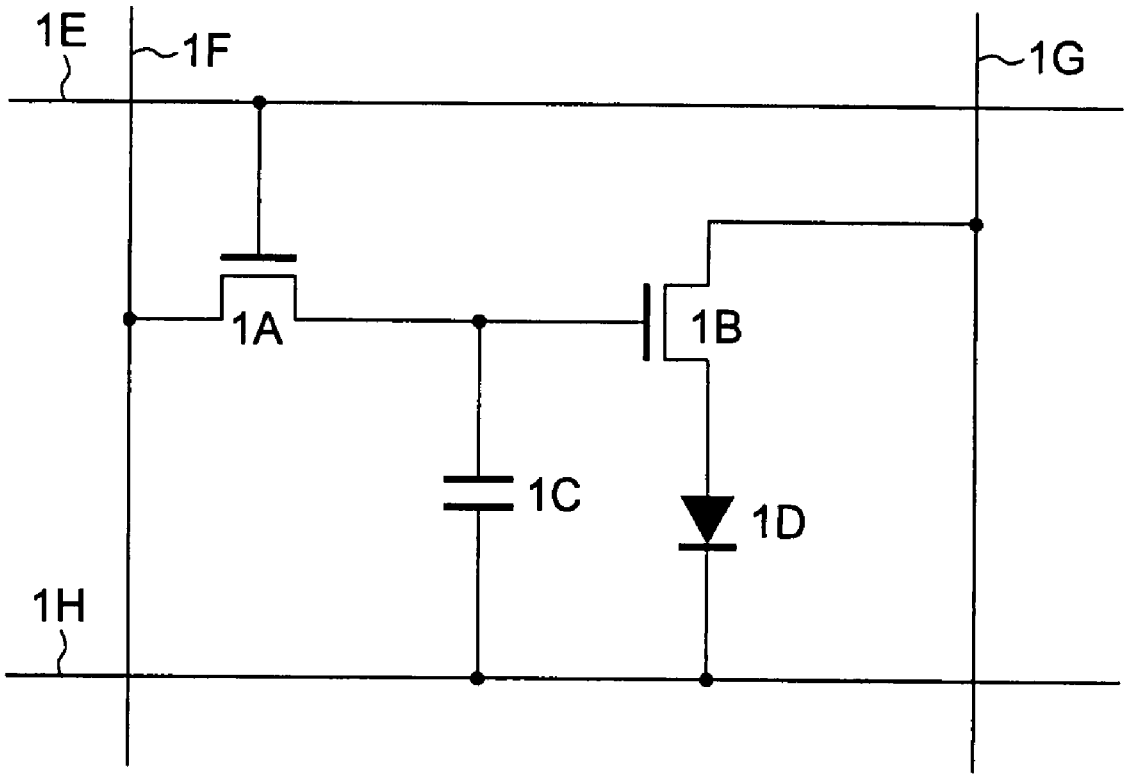
FIG. 1 is a circuit diagram showing a general pixel structure.

Embodiments of the present invention will now be described in detail with reference to the accompanying drawings. First, in order to make it easy to understand an embodiment of the present invention and clarify the background, the general structure of a display device will be described briefly with reference to FIG. 1. FIG. 1 is a schematic circuit diagram showing one pixel of a general display device. As shown, this pixel circuit has a sampling transistor 1A disposed at a cross point of a scan line 1E and a signal line 1F orthogonally disposed. The sampling transistor 1A is an n-type, its gate is connected to the scan line 1E and its drain is connected to the signal line 1F. One electrode of a holding capacitor 1C and a gate of a driver transistor 1B are connected to the source of the sampling transistor 1A. The driver transistor 1B is an n-type, its drain is connected to a power supply line 1G, and its source is connected to an anode of a light emitting element 1D. The other electrode of the holding capacitor 1C and a cathode of the light emitting element ID are connected to a ground wiring 1H.

Figure 2:
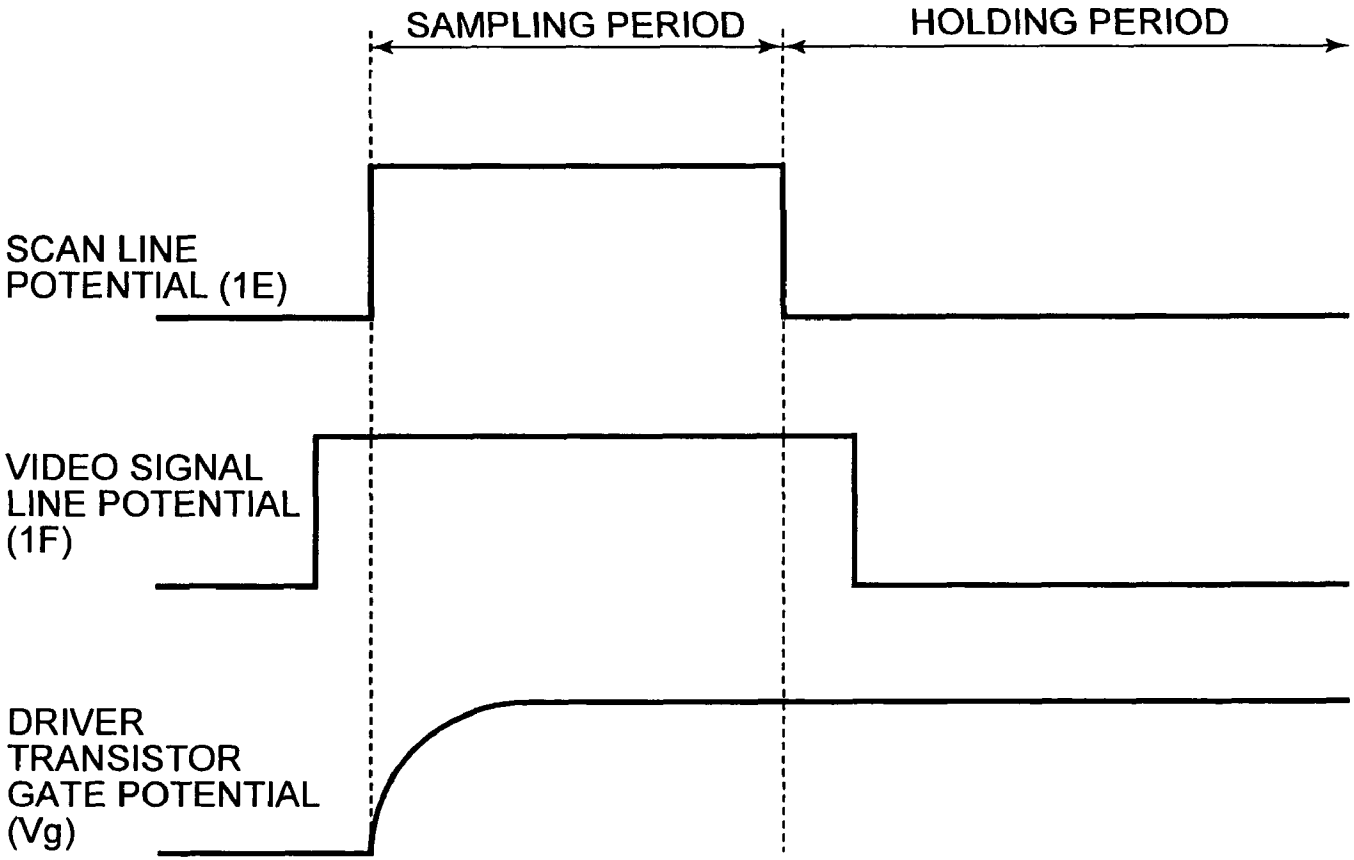
FIG. 2 is a timing chart illustrating the operation of the pixel circuit shown in FIG. 1.

FIG. 2 is a timing chart illustrating the operation of the pixel circuit shown in FIG. 1. This timing chart illustrates an operation of sampling a potential of a video signal (video signal line potential) supplied from the signal line (1F) and makes the light emitting element 1D made of an organic EL device or the like enter an emission state. As a potential of the scan line (1E) (scan line potential) transits to a high level, the sampling transistor (1A) turns on to charge the video signal potential in the holding capacitor (1C). Therefore, the gate potential (Vg) of the driver transistor (1B) starts rising to start flowing a drain current. The anode potential of the light emitting element (1D) rises therefore to start light emission. Thereafter, as the scan line potential transits to a low level, the video signal line potential is held in the holding capacitor (1C), and the gate potential of the driver transistor (1B) becomes constant so that the emission luminance is maintained constant until the next frame.

However, because of a manufacture variation of driver transistors (1B), each pixel has a change in the characteristics such as a threshold voltage and a mobility. Because of the variation in characteristics, even if the same gate potential is applied to the driver transistor (1B), a drain current (driver current) of each pixel varies, resulting in a variation in emission luminances. Furthermore, due to a secular change in the characteristics of the light emitting element (1D) made of an organic EL device or the like, the anode potential of the light emitting element (1D) varies. A variation in anode potentials appears as a change of a gate-source voltage of the driver transistor (1B), resulting in a variation in drain currents (driver currents). A variation in driver currents due to these various causes a variation in emission luminances of pixels, thereby deteriorating the image quality.

Figure 3A:
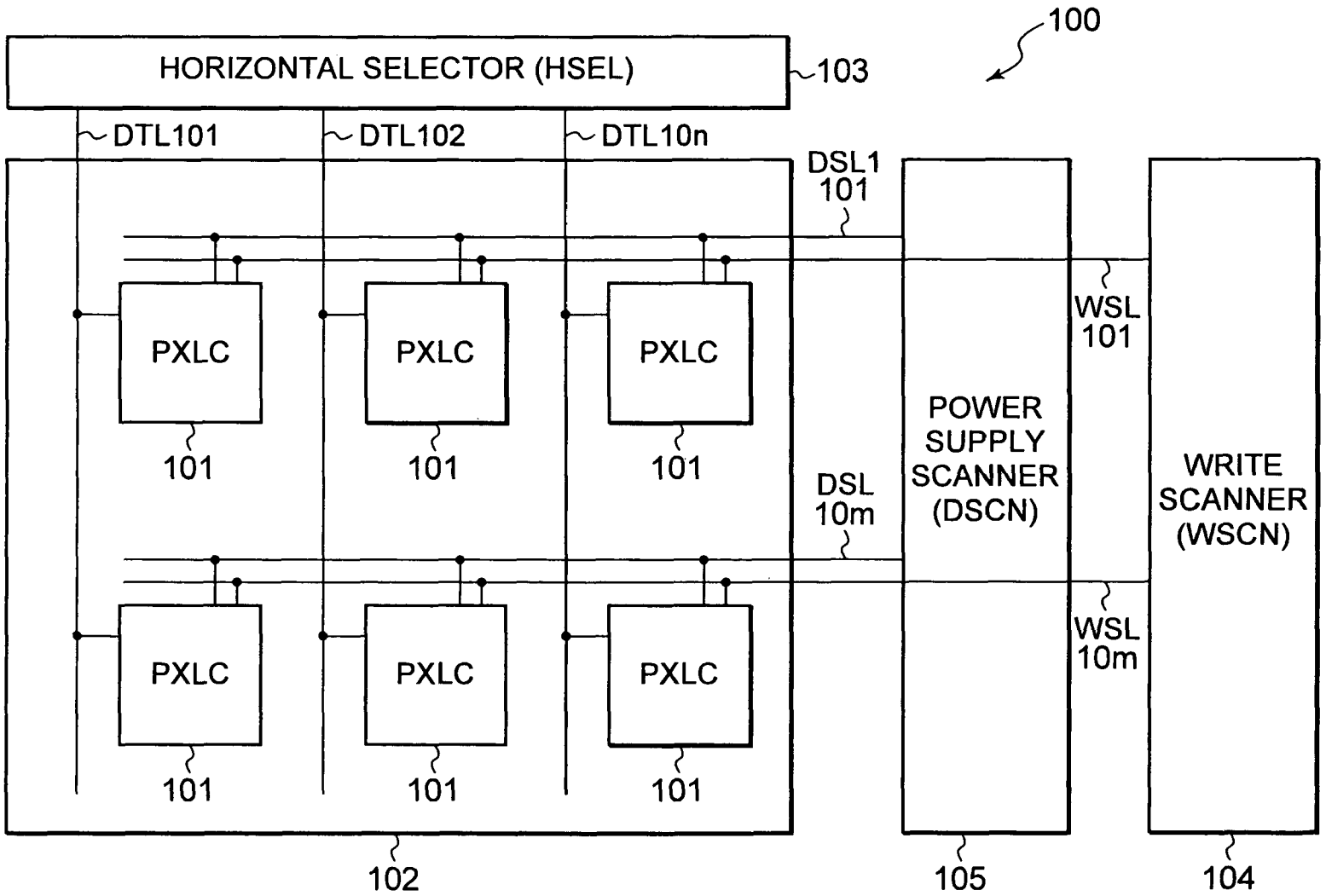
FIG. 3A is a block diagram showing the whole structure of a display device according to an embodiment of the present invention.
Figure 3B:
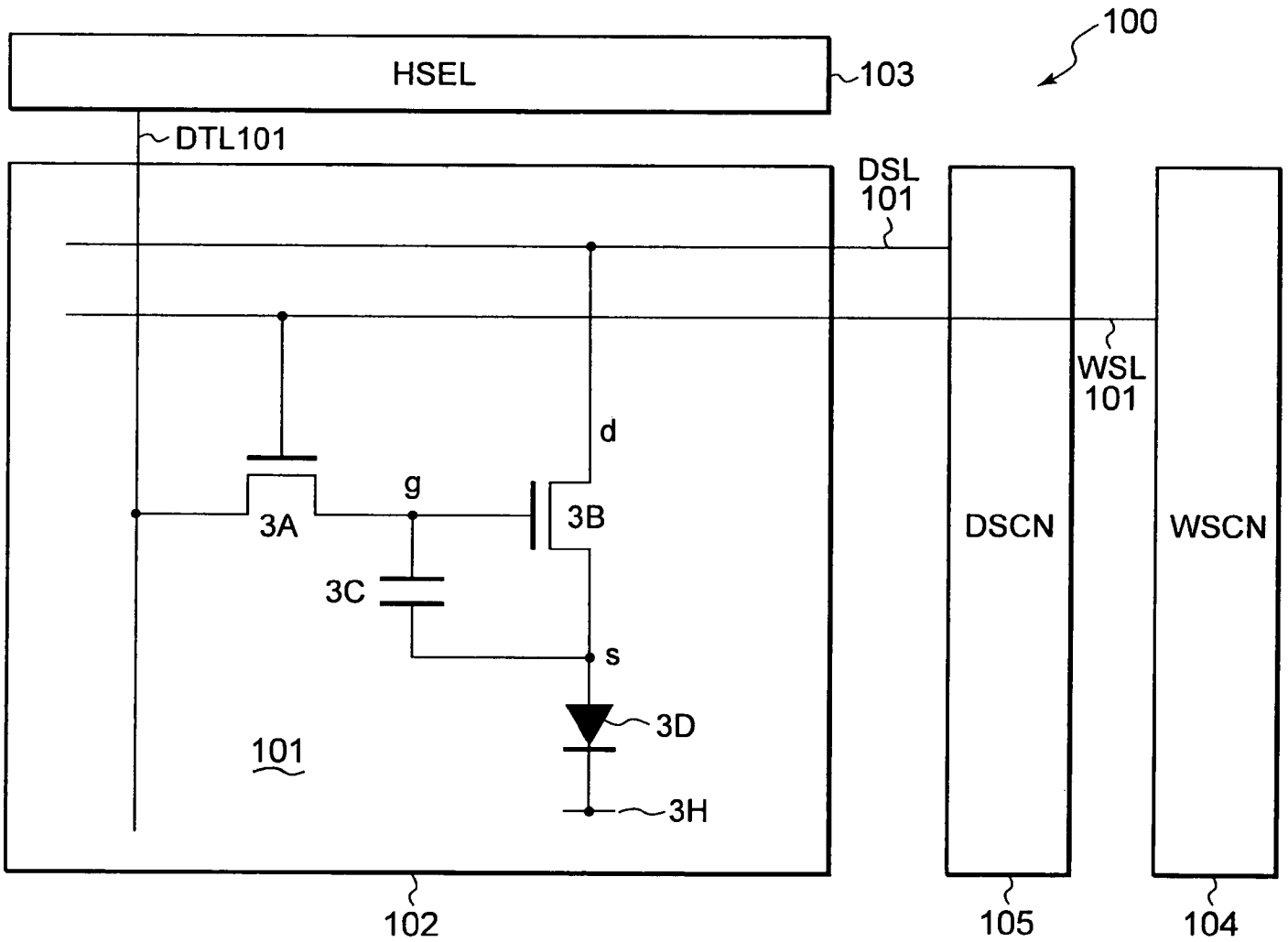
FIG. 3B is a circuit diagram of a display device according to an embodiment of the present invention.

FIG. 3A is a block diagram showing the whole structure of a display device of an embodiment the present invention. As shown, the display device 100 is constituted of a pixel array unit 102 and drive unit (103, 104 and 105) for driving the pixel array portion. The pixel array portion 102 is constituted of row scan lines WSL101 to 10*m*, column signal lines DTL101 to 10*n*, matrix pixels (PXLC) 101 disposed at cross points of the scan and signal lines, and power supply lines DSL 101 to 10*m* disposed at each row of the pixels 101. The drive unit (103, 104 and 105) is composed of a main scanner (write scanner WSCN) 104, a power supply scanner (DSCN) 105, and a signal selector (horizontal selector HSEL) 105. The main scanner 104 sequentially supplies a control signal to each of the scan lines WSL101 to 10*m* to perform line sequential scanning in the row unit. The power supply scanner (DSCN) 105 supplies, synchronously with the line sequential scanning, a power supply voltage switching between first and second potentials to each power supply line DSL 101 to 10*m*. The signal selector (horizontal selector HSEL) 103 supplies, synchronously with the line sequential scanning, a signal potential and a reference potential to the column signal lines DTL101 to 10*n*. The signal potential forms a video signal, FIG. 3B is a circuit diagram showing the specific structure and wiring relation of the pixel 101 in the display device 100 shown in FIG. 3A. As shown, the pixel 101 has a light emitting element 3D made of typically an organic EL device, a sampling transistor 3A, a drive transistor 3B and a holding capacitor 3C. A gate of the sampling transistor 3A is connected to a corresponding scan line WSL101, one of source and drain is connected to a corresponding signal line DTL101, and the other is connected to a gate g of the driver transistor 3B. One of source s and drain d of the driver transistor 3B is connected to the light emitting element 3D and the other is connected to a corresponding power supply line DSL101. In this embodiment, the drain d of the driver transistor 3B is connected to the power supply line DSL101, and the source s is connected to an anode of the light emitting element 3D. A cathode of the light emitting element 3D is connected to a ground wiring 3H. The ground wiring 3H is wired in common to all pixels 101. The holding capacitor 3C is connected across the source s and gate g of the driver transistor 3B.

In the circuit structure described above, the sampling transistor 3A becomes conductive in response to a control signal supplied from the scan line WSL101, and samples the signal potential supplied from the signal line DTL101 to hold the sampled signal potential in the holding capacitor 3C. The driver transistor 3B is supplied with current from the power supply line DSL101 at a first potential, and flows a drive current to the light emitting element 3D in accordance with the signal potential held in the holding transistor 3B. In order to make the sampling transistor 3A conductive during a time period while the signal line DTL101 is at the signal potential, the main scanner (WSCN) 104 outputs the control signal having a shorter pulse width than the time period to the scan line WSL101 to thereby add to the signal potential a correction for a mobility μ of the driver transistor 3B when the signal potential is held in the holding capacitor 3C.

The pixel 101 shown in FIG. 3B is also provided with a threshold voltage correction function in addition to the above-described mobility correction function. Namely, before the sampling transistor 3A samples the signal potential, the power supply scanner (DSCN) 105 changes the power supply line DSL101 from the first potential to a second potential. Before the sampling transistor 3A samples the signal potential, the main scanner (WSCN) 104 makes the sampling transistor 3B conductive at a second timing to apply the reference potential from the signal line DTL101 to the gate g of the driver transistor and set the second potential to the source s of the driver transistor 3B. Generally, the first timing advances from the second timing. In some cases, the order of the first and second timings may be reversed. At a third timing after the second timing, the power supply scanner (DSCN) 105 changes the power supply line DSL101 from the second potential to the first potential, and a voltage corresponding to the threshold voltage Vth of the driver transistor is held in the holding capacitor 3C. With this threshold voltage correction function, the display device 100 can cancel the influence of the threshold voltage of the driver transistor 3B varied for each pixel.

The pixel circuit 101 shown in FIG. 3B has also a bootstrap function. Namely, the main scanner (WSCN) 104 removes the application of the control signal to the scan line WSL101 when the signal potential is held in the holding capacitor 3C to make the sampling transistor 3A non-conductive and electrically disconnect the gate g of the driver transistor 3B from the signal line DTL101. Therefore, the gate potential (Vg) follows a variation in the source potential (Vs) of the driver transistor 3B so that a gate g-source s voltage Vgs can be maintained constant.

Figure 4A:
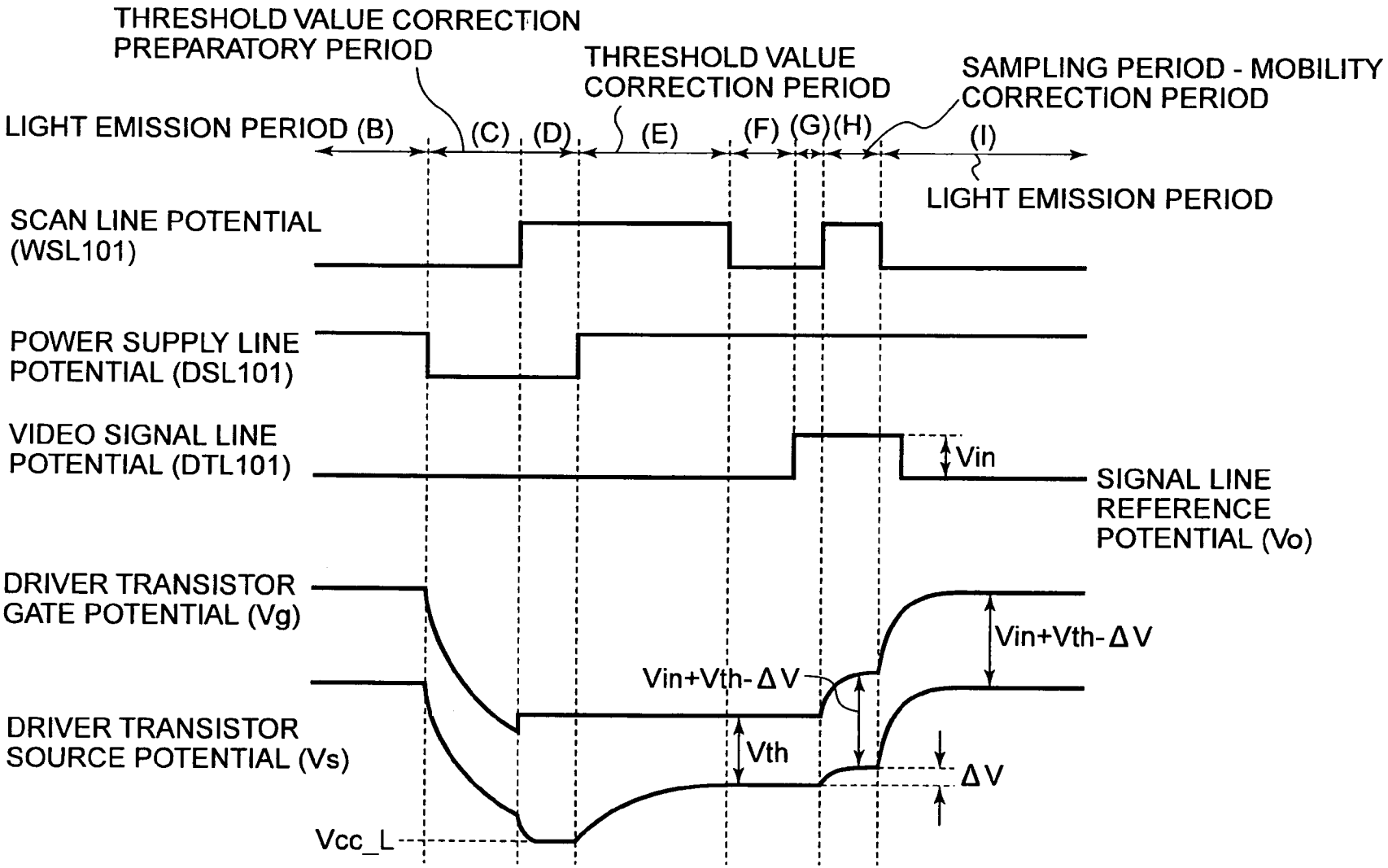
FIG. 4A is a timing chart illustrating the operation of the embodiment shown in FIG. 3B.

FIG. 4A is a timing chart illustrating the operation of the pixel 101 shown in FIG. 3B. A common time axis is used, and the timing chart shows a potential change at the scan line (WSL101), a potential change at the power supply line (DSL101) and a potential change at the signal line (DTL101).

Together with these potential changes, a change in the gate potential (Vg) and source potential (Vs) of the driver transistor 3B is also shown.

In this timing chart, periods (B) to (I) are used for the convenience of description in correspondence with the operation transition of the pixel 101. During a light emission period (B), the light emitting element 3D is in an emission state. Thereafter, a new field of line sequential scanning enters. First, during the first period (C), the power supply line is changed to the low potential. The period advances to the next period (D), and the gate potential Vg and source potential Vs of the driver transistor are initialized. By resetting the gate potential Vg and source potential Vs of the driver transistor 3B during the threshold voltage preparatory periods (C) and (D), preparation for the threshold voltage correction operation is completed. During the next threshold voltage correction period (E), the threshold voltage correction operation is performed actually to hold a voltage corresponding to the threshold voltage Vth across the gate g and source s of the driver transistor 3B. In an actual case, the voltage corresponding to Vth is written in the holding capacitor 3C connected across the gate g and source s of the driver transistor 3B.

After the preparatory periods (F) and (G) for mobility correction, the period advances to the sampling period-mobility correction period (H). During this period, the signal potential Vin of the video signal is written in the holding capacitor 3C, being added to Vth, and a mobility correction voltage ΔV is subtracted from the voltage held in the holding capacitor 3C. During the sampling period-mobility correction period (H), in order to make the sampling transistor 3A conductive during a time period while the signal line DTL101 is at the signal potential Vin, the control signal having a shorter pulse width than the time period is outputted to the scan line WSL101 to thereby add to the signal potential Vin a correction for a mobility μ of the driver transistor 3B when the signal potential Vin is held in the holding capacitor 3C.

Thereafter, with the light emission period (I) entered, the light emitting element emits light at a luminance corresponding to the signal voltage Vin. In this case, since the signal voltage Vin is adjusted by the voltage corresponding to the threshold voltage Vth and the mobility correction voltage ΔV, the emission luminance of the light emitting element 3D is not influenced by a variation in the threshold voltage Vth and mobility μ of the driver transistor 3B. A bootstrap operation is executed at the start of the light emission period (I), and the gate potential Vg and source potential Vs of the driver transistor 3B rise while the gate-source voltage Vgs=Vin+Vth−ΔV of the driver transistor 3B is maintained constant.

Figure 4B:
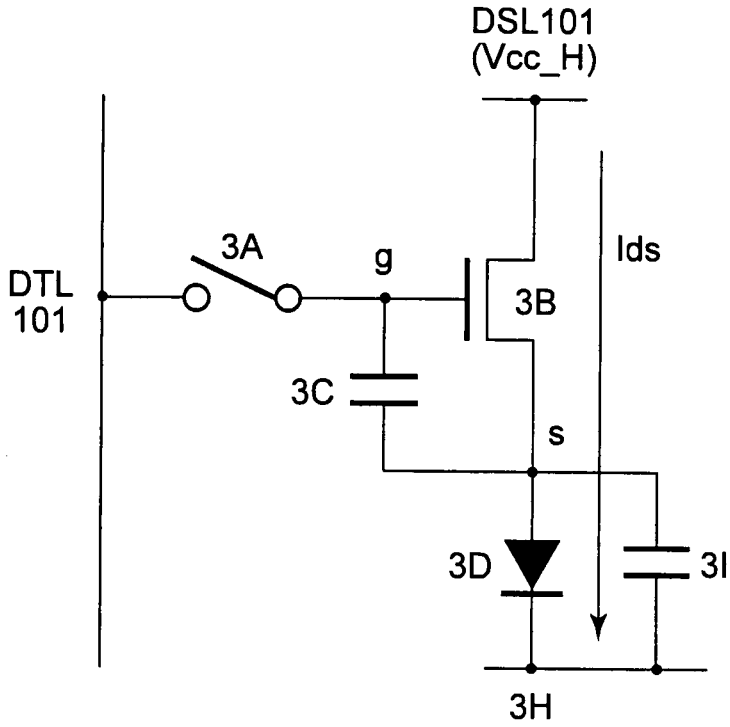
FIG. 4B is a circuit diagram illustrating the operation of the embodiment.

With reference to FIGS. 4B to 4I, the operation of the pixel 101 shown in FIG. 3B will be described in detail. Representation of FIGS. 4B to 4I corresponds to the periods (B) to (I) of the timing chart shown in FIG. 4A, respectively. In FIGS. 4B to 4I, the capacitive component of the light emitting element 3D is drawn as a capacitor element 31 for the convenience of description and easy understanding. First, as shown in FIG. 4B, during the light emission period (B), a power supply line DSL101 is at a high potential Vcc_H (first potential) and a driver transistor 3B supplies a drive current Ids to a light emitting element 3D. As shown, the drive current Ids flows from the power supply line DSL101 at the high potential Vcc_H to the light emitting element 3D via the driver transistor 3B and thereafter to a common ground wiring 3H.

Figure 4C:
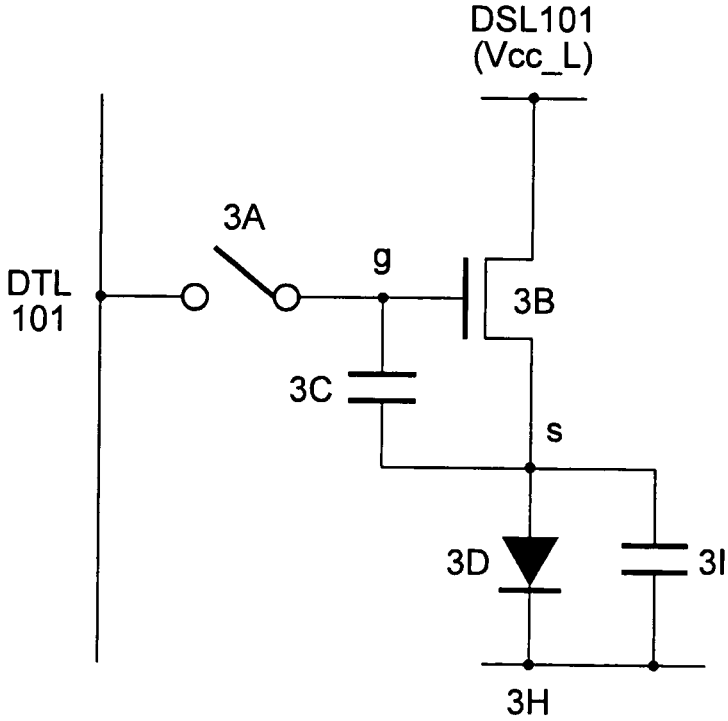
FIG. 4C is a circuit diagram illustrating the operation of the embodiment.

Next, with the period (C) entered, the power supply line DSL101 is changed from the high potential Vcc_H to the low potential Vcc_L as shown in FIG. 4C. The power supply line DSL101 is therefore discharged to Vcc_L, and the source potential Vs of the driver transistor 3B transits to a potential near Vcc_L. If a wiring capacitance of the power supply line DSL101 is large, the power supply line DSL101 is changed from the high potential Vcc_H to the low potential Vcc_L at a relatively early timing. This period (C) is retained sufficiently so as not to be influenced by a wiring capacitance and other pixel parasitic capacitance.

Figure 4D:
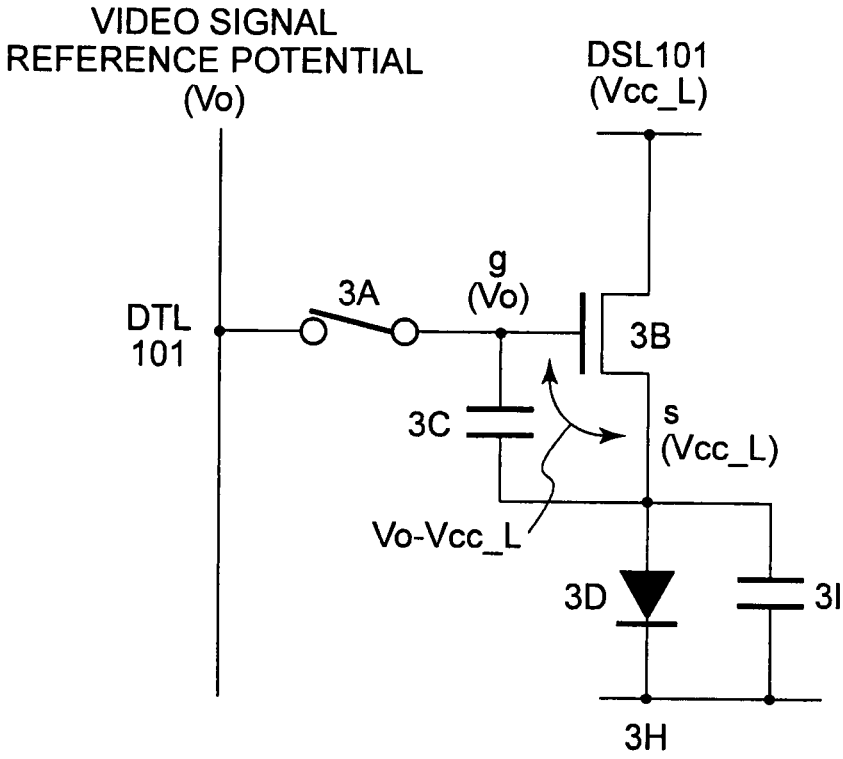
FIG. 4D is a circuit diagram illustrating the operation of the embodiment.

With the period (D) entered next, the scan line WSL101 is changed from the low level to the high level to make the sampling transistor 3A conductive as shown in FIG. 4D. At this time, the video signal line DTL101 takes the reference potential Vo. Therefore, the gate potential Vg of the driver transistor 3B takes the reference potential Vo of the video signal line DTL101 via the conductive sampling transistor 3A. At the same time, the source potential Vs of the driver transistor 3B is fixed immediately to the low potential Vcc_L. With these operations, the source potential Vs of the driver transistor 3B is initialized (reset) to the potential Vcc_L sufficiently lower than the reference potential Vo at the video signal line DTL. More specifically, the low potential Vcc_L (second potential) is set to the power supply line DSL101 so that a gate-source voltage Vgs (a difference between the gate potential Vg and source potential Vs) of the driver transistor 3B becomes higher than the threshold voltage Vth of the driver transistor 3B.

Figure 4E:
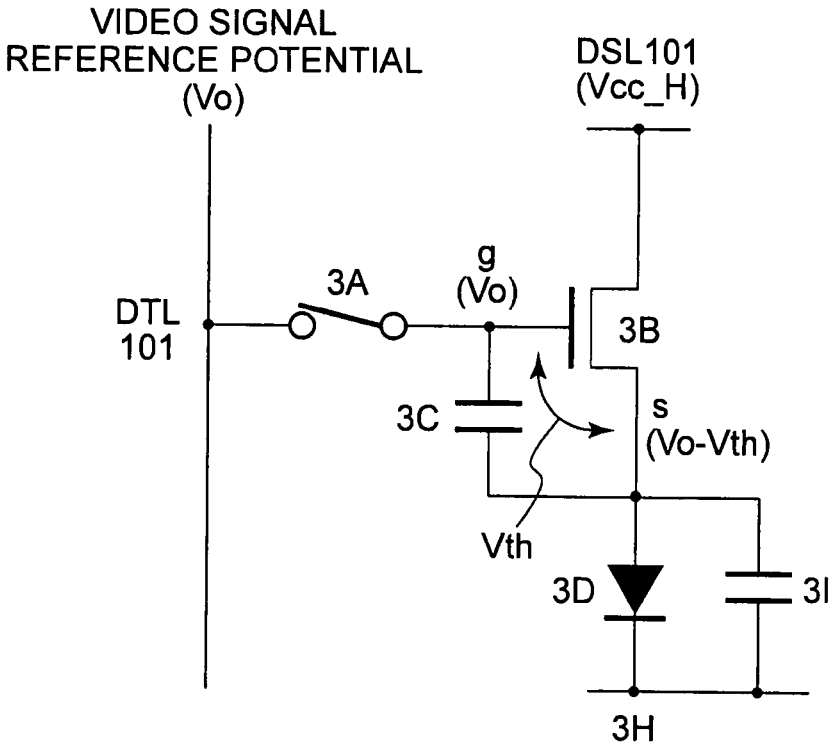
FIG. 4E is a circuit diagram illustrating the operation of the embodiment.

Subsequently, with the threshold voltage correction period (E) entered, the potential of the power supply line DSL101 transits from the low potential Vcc_L to the high potential Vcc_H, and the source potential Vs of the driver transistor 3B starts rising, as shown in FIG. 4E. When the gate-source voltage Vgs of the driver transistor 3B takes the threshold voltage Vth, current is cut off. In this way, a voltage corresponding to the threshold voltage Vth of the driver transistor 3B is written in the holding capacitor 3C. This operation is the threshold voltage correction operation. At this time, a potential at the common ground wiring 3H is set so that the light emitting element 3D is cut off in order that current flows mainly on the side of the holding capacitor 3C and does not flow on the side of the light emitting element 3D.

Figure 4F:
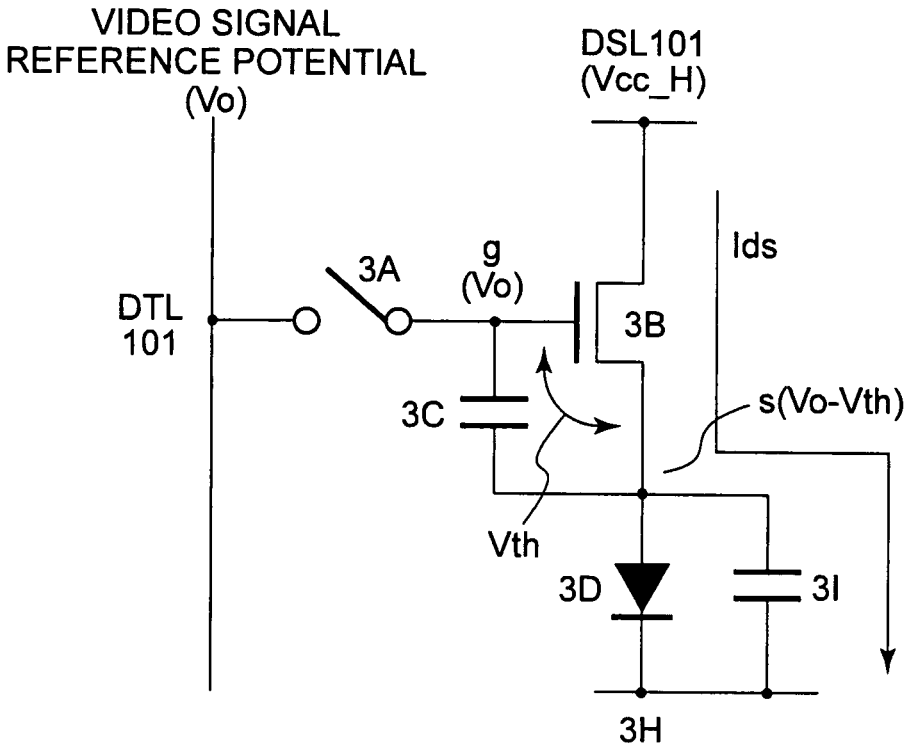
FIG. 4F is a circuit diagram illustrating the operation of the embodiment.

With the period (F) entered, as shown in FIG. 4F, the scan line WSL101 transits to the low potential side, and the sampling transistor 3A enters once an off-state. At this time, although the gate g of the driver transistor 3B takes a floating state, it is in a cutoff state and the drain current Ids will not flow because the gate-source voltage Vgs is equal to the threshold voltage Vth of the driver transistor 3B.

Figure 4G:
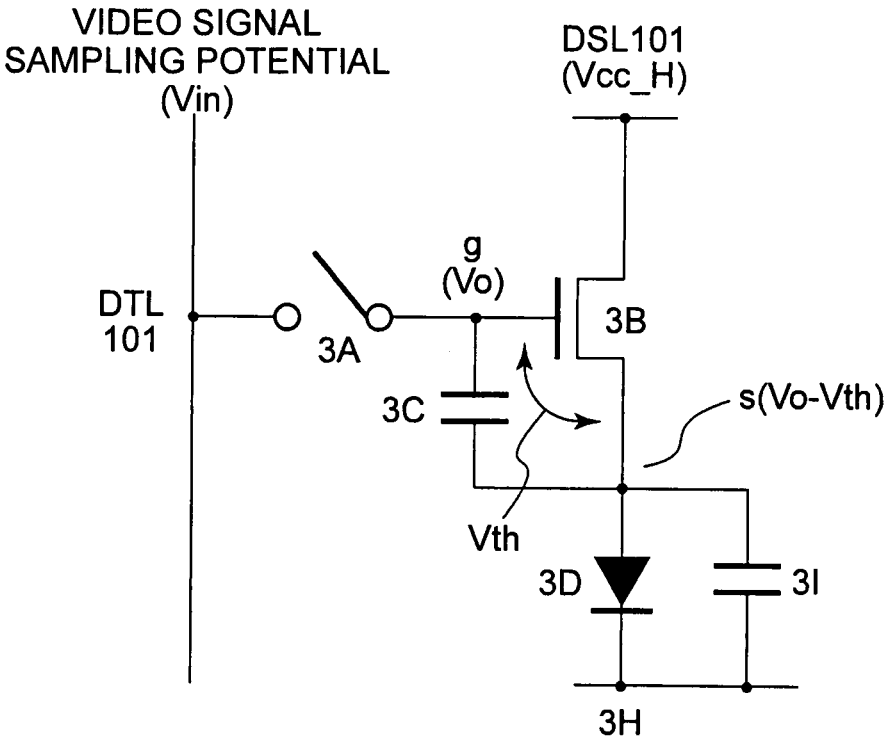
FIG. 4G is a circuit diagram illustrating the operation of the embodiment.

Subsequently to the period (G) entered, as shown in FIG. 4G, the potential of the video signal line DTL101 transits from the reference potential Vo to the sampling potential (signal potential) Vin. Preparation for the next sampling operation and mobility correction operation can therefore be completed.

Figure 4H:
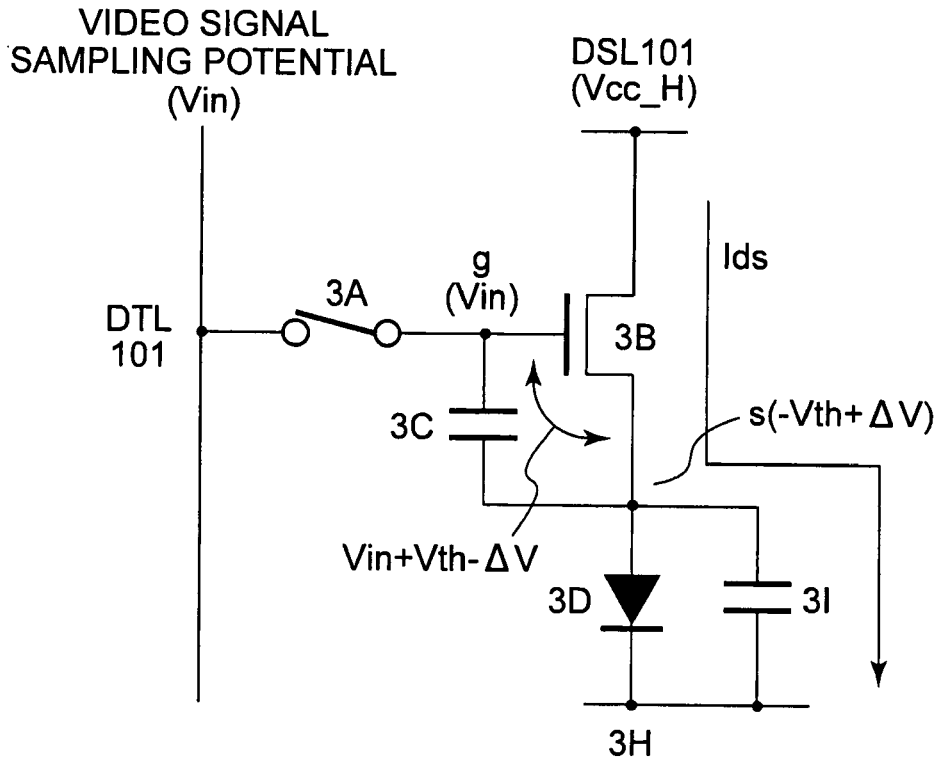
FIG. 4H is a circuit diagram illustrating the operation of the embodiment.

With the sampling period-mobility correction period (H) entered, as shown in FIG. 4H, the scan line WSL101 transits to the high potential side and the sampling transistor 3A tunes on. Therefore, the gate potential Vg of the driver transistor 3*b* becomes the signal potential Vin. Since the light emitting element 3D is initially in a cutoff state (high impedance state), the drain-source current Ids of the driver transistor 3B flows into the light emitting element capacitor 31 to start charging. The source potential Vs of the driver transistor 3B starts rising, and the gate-source voltage Vgs of the driver transistor 3B eventually takes Vin+Vth−ΔV.

In this manner, sampling the signal potential Vin and adjusting the correction amount ΔV are performed at the same time. The higher Vin is, the larger the current Ids becomes and the larger the absolute value of ΔV becomes. Therefore, a mobility correction in accordance with an emission luminance level can be performed. If Vin is constant, the larger the mobility μ of the driver transistor 3B is, the larger the absolute value of ΔV is. In other words, since the negative feedback amount ΔV becomes larger as the mobility μ becomes higher, a variation in mobilities of pixels can be removed.

Figure 4I:
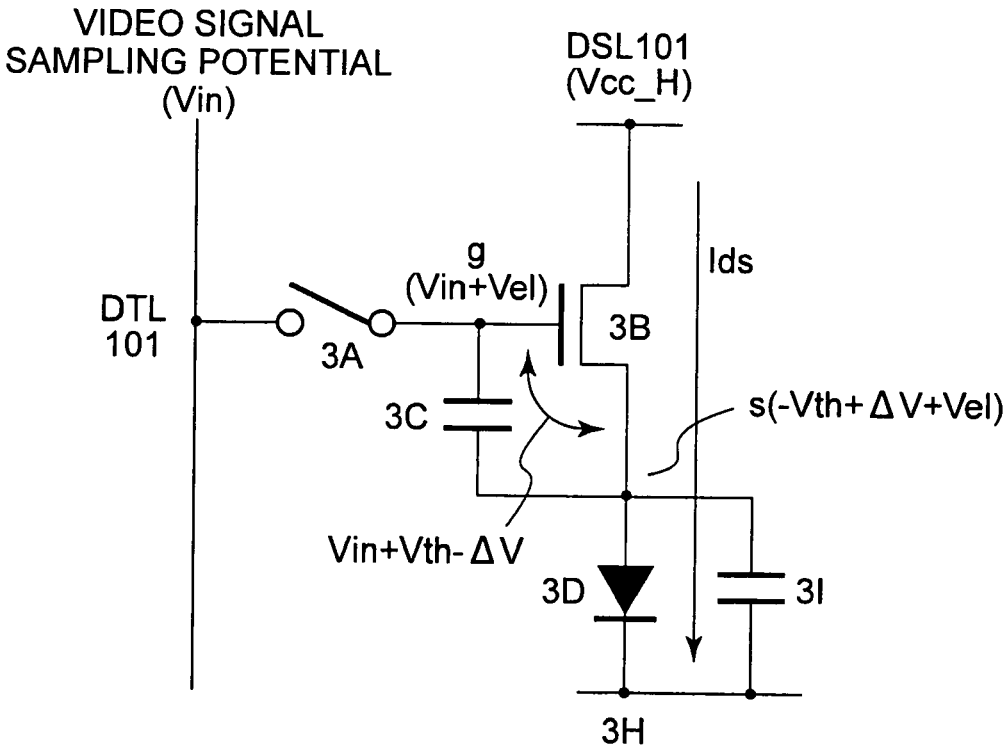
FIG. 4I is a circuit diagram illustrating the operation of the embodiment.

Lastly, with the light emission period (G) entered, the scan line WSL101 transits to the low potential side and the sampling transistor 3A turns off, as shown in FIG. 4I. The gate g of the driver transistor 3B is therefore disconnected from the signal line DTL101. At the same time, a drain current Ids starts flowing in the light emitting element 3D. Thus, the anode potential of the light emitting element 3D rises by Vel in accordance with the drive current Ids. A rise of the anode potential of the light emitting element 3D is a rise of the source potential Vs of the driver transistor 3B. As the source potential Vs of the driver transistor 3B rises, the gate potential Vg of the driver transistor 3B rises by the bootstrap operation of the holding capacitor 3C. A rise amount Vel of the gate potential Vg is equal to a rise amount Vel of the source potential Vs. Therefore, the gate-source voltage Vgs of the driver transistor 3B during the light emission period is maintained constant at Vin+Vth−ΔV.

Figure 5A:
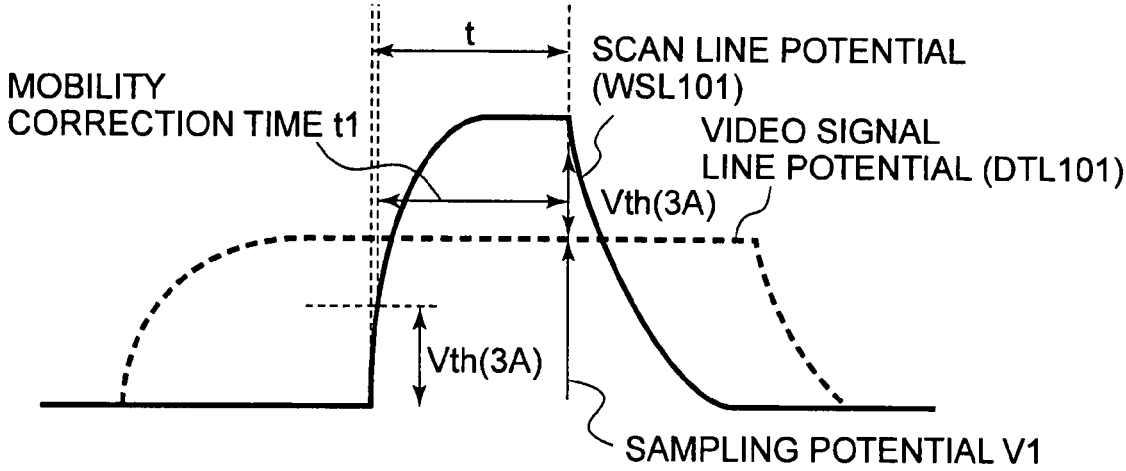
FIGS. 5A and 5B show waveforms illustrating the operation of the embodiment.
Figure 5B:
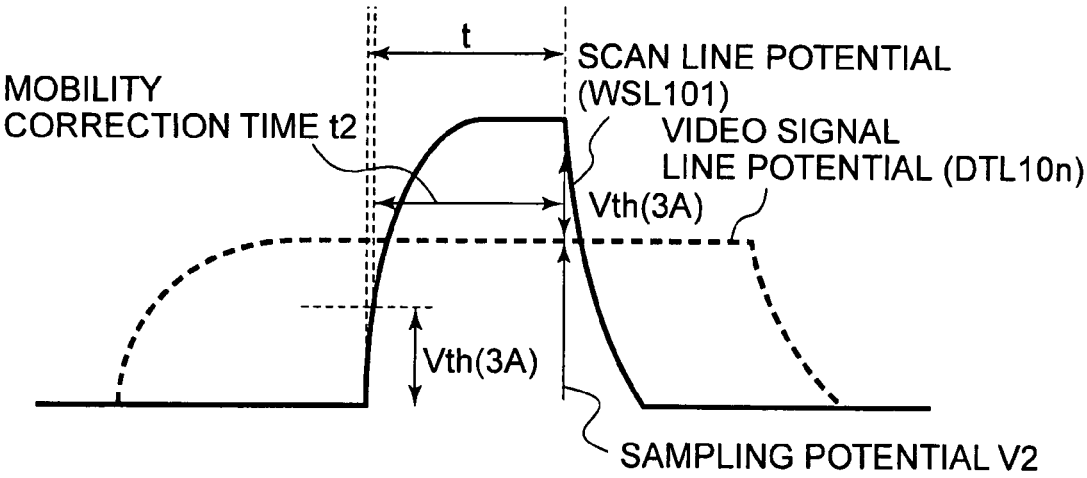

FIGS. 5A and 5B are schematic diagrams showing scan line potential waveforms and video signal potential waveforms during the sampling period-mobility correction period (H). The waveforms shown in FIG. 5A are waveforms observed on an away side of the write scanner 104 shown in FIG. 3A, and the waveforms shown in FIG. 5B are waveforms observed on a near side of the write scanner 104. On the away side, the waveform of the scan line potential (i.e., control signal pulse) is made dull and deteriorated greatly by the influence of wiring capacitance and resistance. In contrast, on the near side, the control pulse is not influenced so much by the wiring capacitance and resistance so that the waveform is not deteriorated. The video signal line potential has no difference of waveforms both on the away and near sides because of the same distance from the horizontal selector 103 as the signal source.

The mobility correction time is determined by a range in which the time width of the video signal line at the signal potential superposes upon the control signal pulse. According to an embodiment of the present invention, the control signal pulse width t is made narrow so as to be included in the time width of the video signal line at the signal potential so that the mobility correction time t1 is determined by the control signal pulse width t. More precisely, the mobility correction time is from when the control signal pulse rises and the sampling transistor turns on to when the control signal pulse falls and the sampling transistor turns off. As shown, the on-timing of the sampling transistor 3A is when the gate potential (i.e., scan line potential) exceeds the threshold voltage Vth relative to the source potential (i.e., video signal line potential). Conversely, the off-timing of the sampling transistor 3A is when the gate potential lowers by Vth (3A) relative to the source potential. As shown, the mobility correction time is t1 on the away side deteriorating the waveform greatly, and the mobility correction time is t2 on the near side not deteriorating the waveform so much. As compared to the near side, on the away side deteriorating the waveform greatly, the on-timing of the sampling transistor shifts backward, and also the off-timing shifts backward. Therefore, the mobility correction time t1 determined by a difference therebetween does not change so much from the mobility correction time t2 on the near side.

The signal potential (sampling potential) finally sampled by the sampling transistor 3A is given by the video signal line potential just when the sampling transistor 3A turns off. As seen from FIGS. 5A and 5B, the sampling potentials V1 and V1 have no difference from the signal potential Vin both on the away and near sided to an embodiment of the present invention, the video signal potentials V1 and V2 have almost no difference on the away and near sides. A difference between the mobility correction times t1 and t2 is almost negligible. An embodiment of the present invention can therefore provide a display device having a good image quality without a luminance difference between right and left of the screen and having suppressed shading.

Figure 6A:
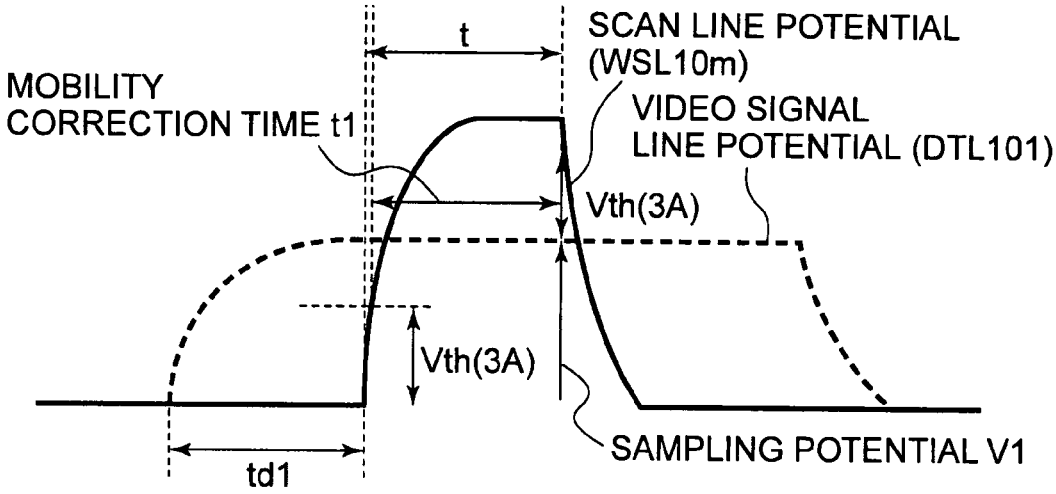
FIGS. 6A and 6B show waveforms illustrating the operation of the embodiment.
Figure 6B:
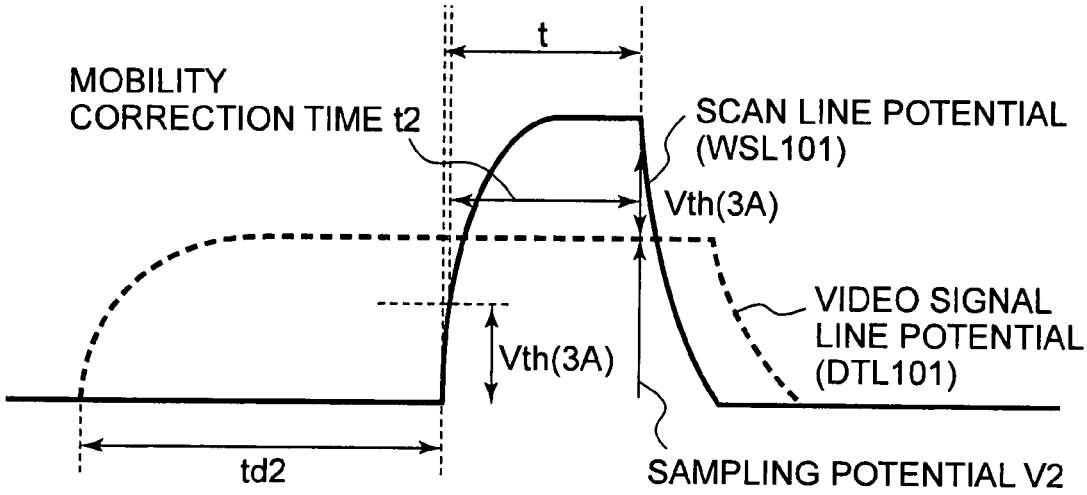

FIGS. 6A and 6B show also the scan line potential waveforms and video signal line potential waveforms observed during the sampling period-mobility correction period (H). The waveforms shown in FIG. 6A are waveforms observed in the lower screen away from the horizontal selector 103, and the waveforms shown in FIG. 6B are waveforms observed in the upper screen near the horizontal selector 103. Since the waveforms of the control signal pulse (scan line potential waveforms) have no difference because of the same position in the upper and lower screens. The video signal line potential is delayed more in the lower screen than the upper screen because of wiring capacitance and resistance. However, even if the signal potential waveform on the video signal line is delayed, there is almost no difference between sampling potentials and mobility correction times if the control signal pulse is included in the time width of the signal potential on the video signal line. As seen from FIGS. 6A and 6B, the sampled video signal potentials V1 and V2 are approximately equal in the upper and lower screens. The mobility correction times t1 and t2 are also approximately equal. A luminance difference in the upper and lower screens can therefore be suppressed and a display device of a good image quality can be provided.

Figure 7A:
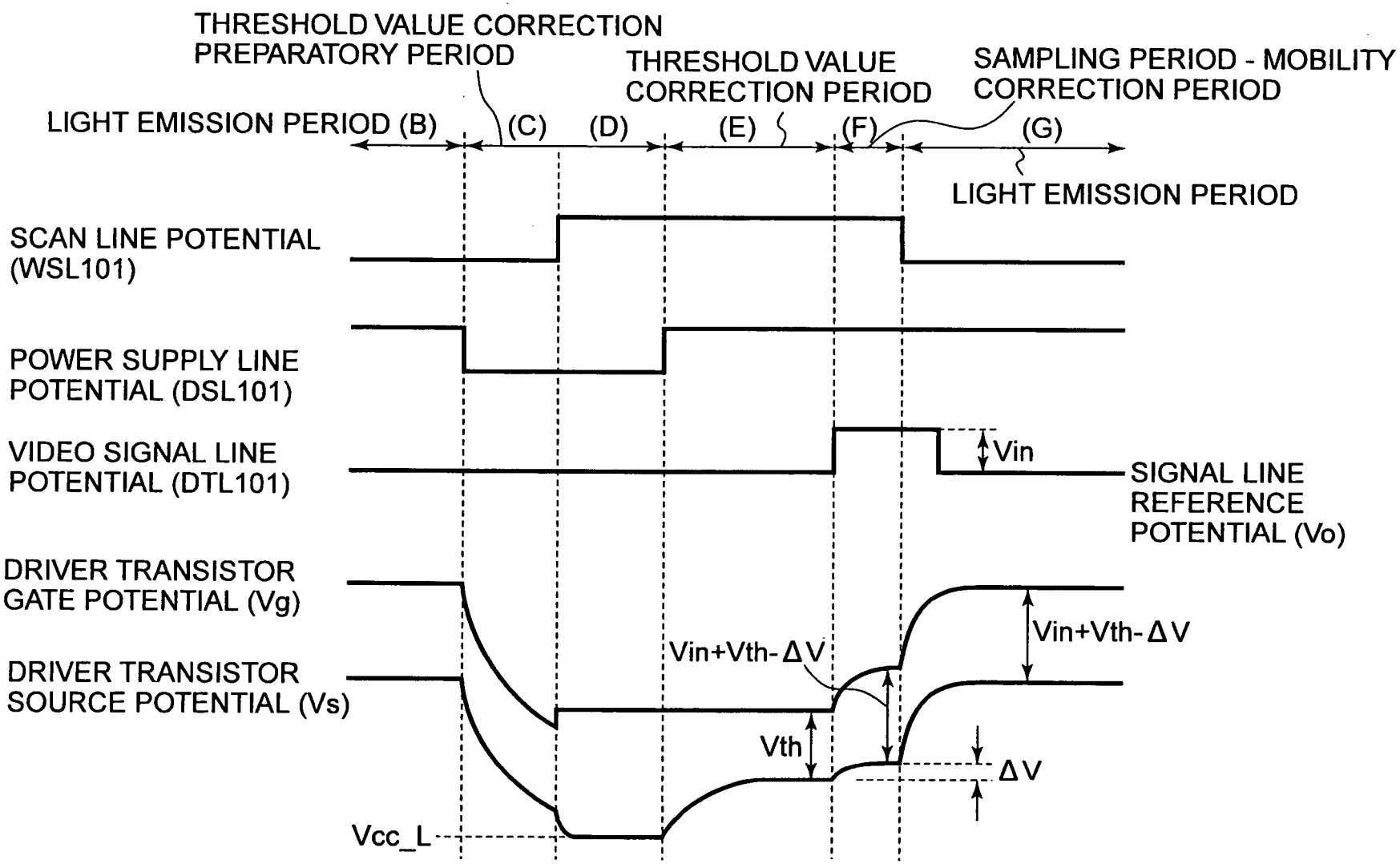
FIG. 7A is a timing chart illustrating a reference example of a driving method for a display device.

FIG. 7A shows a reference example of the driving method for the display device shown in FIG. 3B. In order to make it easy to understood, the same format as that of the timing chart shown in FIG. 4A is adopted. A different point is the control method for the sampling period-mobility correction period. As shown in FIG. 7A of the reference example, the sampling period-mobility correction period is set from when the video signal line rises from the reference potential Vo to the signal potential Vin and to when the scan line falls from the high potential to the low potential.

Figure 7B:
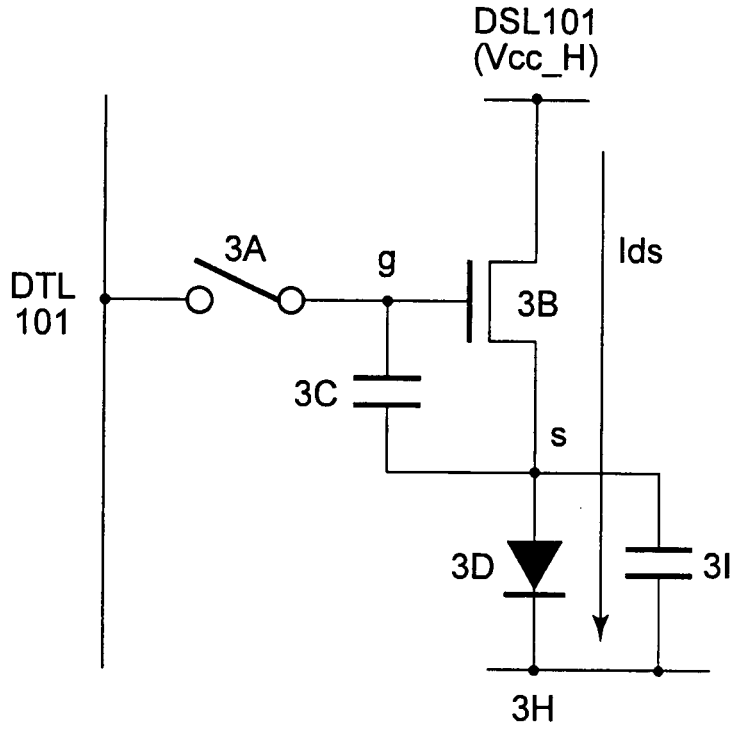
FIG. 7B is a circuit diagram illustrating the operation of the reference example.

With reference to FIGS. 7B to 7G, description will be made further on the operation method of the reference example shown in FIG. 7A. First, as shown in FIG. 7B, during the light emission period (B), a power supply line DSL101 is at a high potential Vcc_H (first potential) and a driver transistor 3B supplies a drive current Ids to a light emitting element 3D. As shown, the drive current Ids flows from the power supply line DSL101 at the high potential Vcc_H to the light emitting element 3D via the driver transistor 3B and thereafter to a common ground wiring 3H.

Figure 7C:
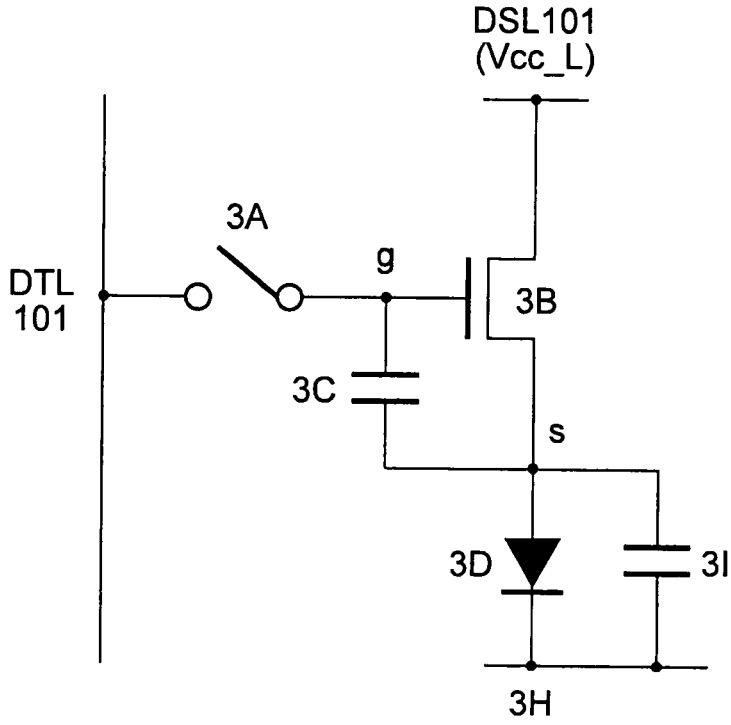
FIG. 7C is a circuit diagram illustrating the operation of the reference example.
Figure 7D:
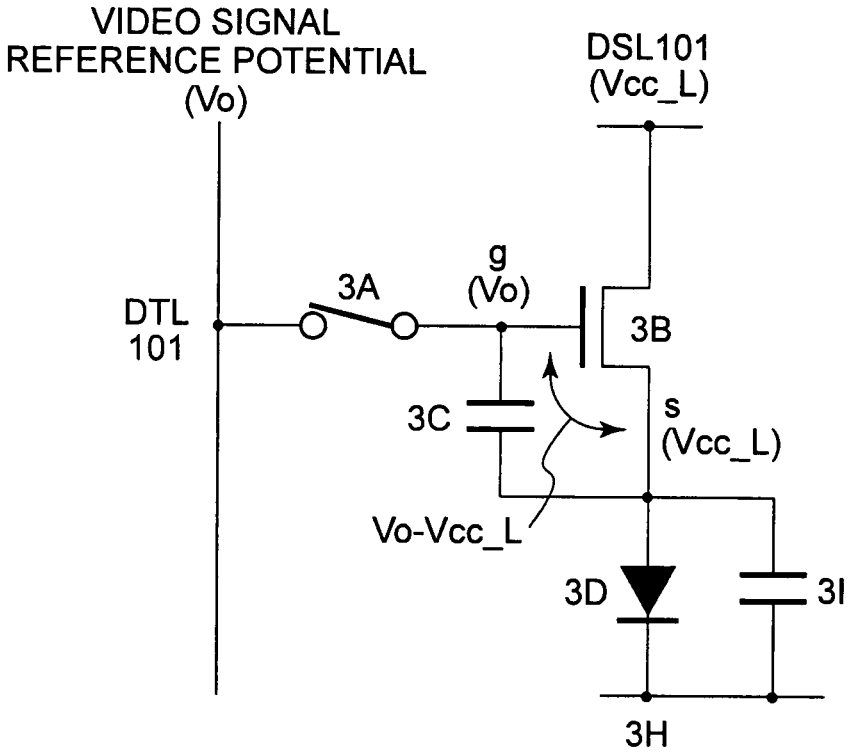
FIG. 7D is a circuit diagram illustrating the operation of the reference example.

Next, with the period (C) entered, the power supply line DSL101 is changed from the high potential Vcc_H to the low potential Vcc-L as shown in FIG. 7C. The power supply line DSL101 is therefore discharged to Vcc_L, and the source potential Vs of the driver transistor 3B transits to a potential near Vcc_L. If a wiring capacitance of the power supply line DSL101 is large, it is desirable that the power supply line DSL101 is changed from the high potential Vcc_H to the low potential Vcc_L at a relatively early timing. This period (C) is retained sufficiently so as not to be influenced by a wiring capacitance and other pixel parasitic capacitance.

Subsequently, with the period (D) entered, the scan line WSL101 is changed from the low level to the high level to make the sampling transistor 3A conductive as shown in FIG.

7D. At this time, the video signal line DTL101 takes the reference potential Vo. Therefore, the gate potential Vg of the driver transistor 3B takes the reference potential Vo of the video signal line DTL101 via the conductive sampling transistor 3A. At the same time, the source potential Vs of the driver transistor 3B is fixed immediately to the low potential Vcc_L. With these operations, the source potential Vs of the driver transistor 3B is initialized (reset) to the potential Vcc_L sufficiently lower than the reference potential Vo at the video signal line DTL. More specifically, the low potential Vcc_L (second potential) is set to the power supply line DSL101 so that a gate-source voltage Vgs (a difference between the gate potential Vg and source potential Vs) of the driver transistor 3B becomes higher than the threshold voltage Vth of the driver transistor 3B.

Figure 7E:
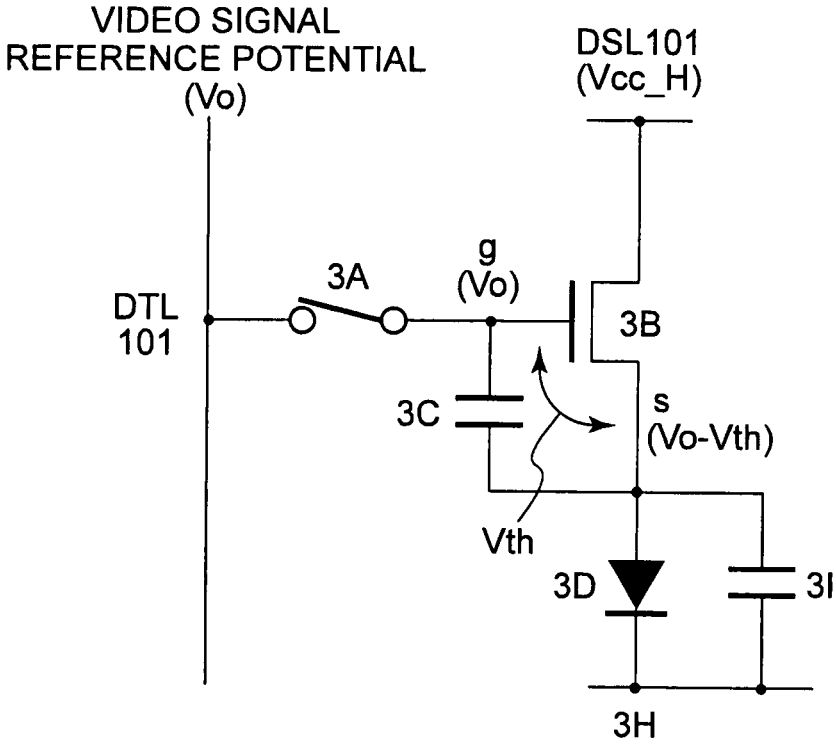
FIG. 7E is a circuit diagram illustrating the operation of the reference example.

With the threshold voltage correction period (E) entered next, the potential of the power supply line DSL101 transits from the low potential Vcc_L to the high potential Vcc_H, and the source potential Vs of the driver transistor 3B starts rising, as shown in FIG. 7E. When the gate-source voltage Vgs of the driver transistor 3B takes the threshold voltage Vth, current is cut off. In this way, a voltage corresponding to the threshold voltage Vth of the driver transistor 3B is written in the holding capacitor 3C. This operation is the threshold voltage correction operation. A potential at the common ground wiring 3H is set so that the light emitting element 3D is cut off, and current flows mainly on the side of the holding capacitor 3C and does not flow on the side of the light emitting element 3D.

Figure 7F:
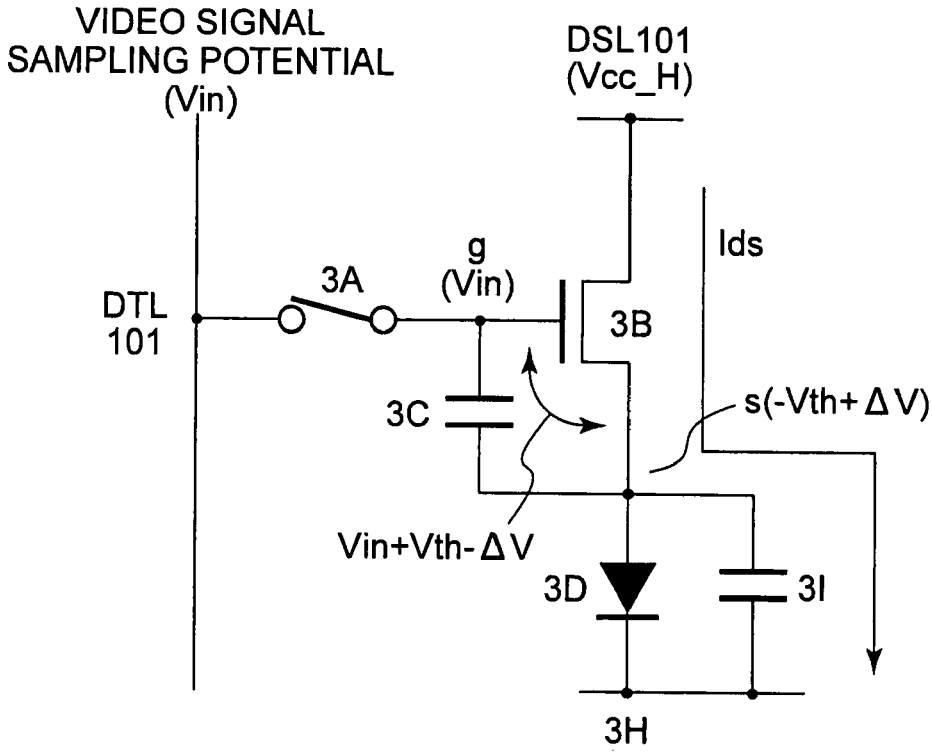
FIG. 7F is a circuit diagram illustrating the operation of the reference example.

Next, with the sampling period-mobility correction period (F) entered, as shown in FIG. 7F, a potential of the video signal line DTL101 transits from the reference potential Vo to the signal potential Vin so that the gate potential Vg of the driver transistor 3B takes Vin. Since the light emitting element 3D is initially in a cutoff state (high impedance state), the drain current Ids of the driver transistor 3B flows into the parasitic capacitor 31 of the light emitting element capacitor and the parasitic capacitor 31 of the light emitting element starts charging. The source potential Vs of the driver transistor 3B starts rising, and the gate-source voltage Vgs of the driver transistor 3B eventually takes Vin+Vth−ΔV. In this manner, sampling the signal potential Vin and adjusting the correction amount ΔV are performed. The higher Vin is, the larger the current Ids becomes and the larger the absolute value of ΔV becomes. It is therefore possible to perform a mobility correction in accordance with an emission luminance level. If Vin is constant, the larger the mobility μ of the driver transistor 3B is, the larger the absolute value of ΔV is. In other words, since the negative feedback amount ΔV becomes larger as the mobility μ becomes higher, a variation in mobilities of pixels can be removed.

Figure 7G:
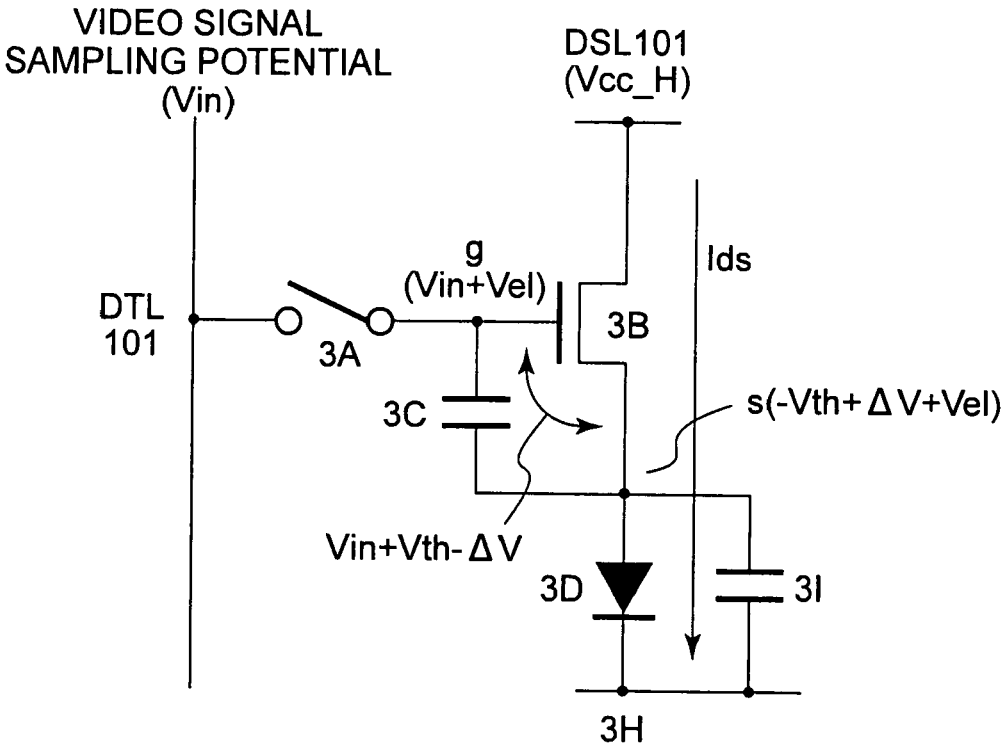
FIG. 7G is a circuit diagram illustrating the operation of the reference example.

With the light emission period (G) entered lastly, the scan line WSL101 transits to the low potential side and the sampling transistor 3A turns off, as shown in FIG. 7G. The gate g of the driver transistor 3B is therefore disconnected from the signal line DTL101. At the same time, a drain current Ids starts flowing in the light emitting element 3D. The anode potential of the light emitting element 3D rises by Vel in accordance with the drive current Ids. A rise of the anode potential of the light emitting element 3D is a rise of the source potential Vs of the driver transistor 3B. As the source potential Vs of the driver transistor 3B rises, the gate potential Vg of the driver transistor 3B rises by the bootstrap operation of the holding capacitor 3C. A rise amount Vel of the gate potential Vg is equal to a rise amount Vel of the source potential Vs. Therefore, the gate-source voltage Vgs of the driver transistor 3B during the light emission period is maintained constant at Vin+Vth−ΔV.

Figure 8A:
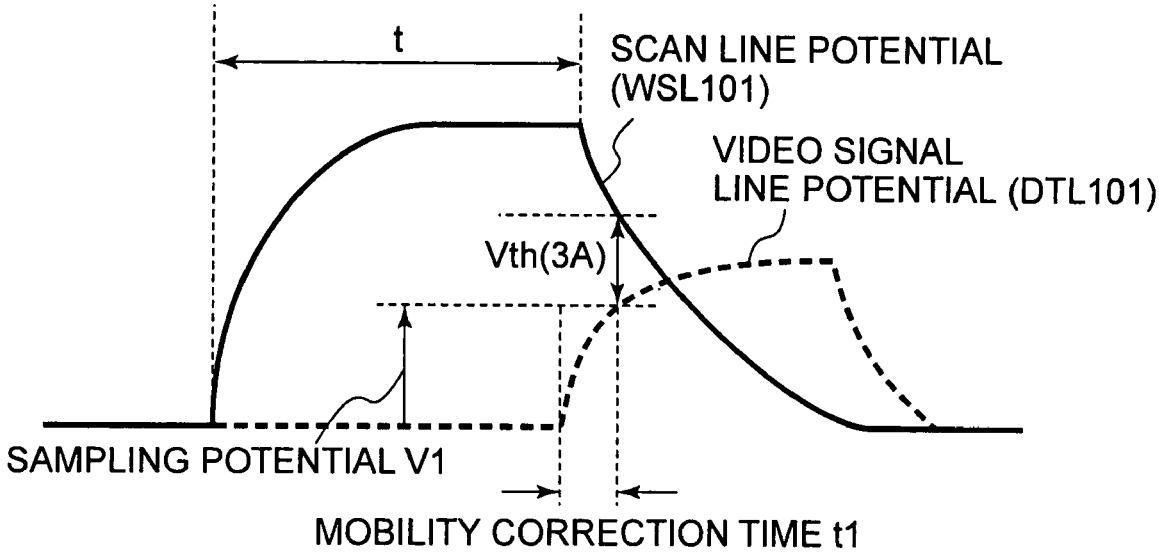
FIGS. 8A and 8B show waveforms illustrating the operation of the reference example.
Figure 8B:
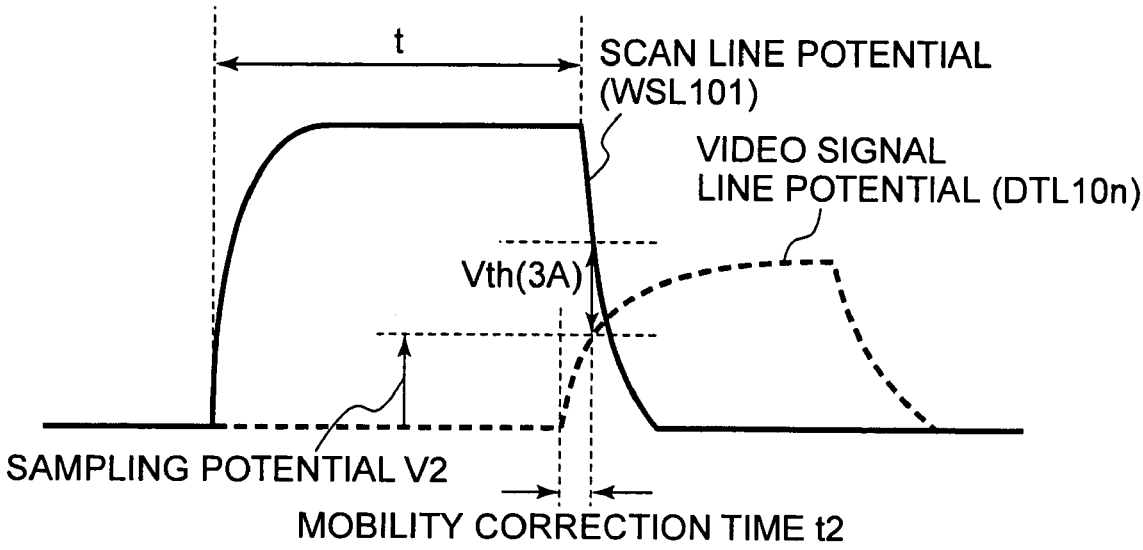

FIGS. 8A and 8B show scan line potential waveforms and video signal potential waveforms during the sampling period-mobility correction period (F) in the reference example shown in FIG. 7A. In order to make it easy to understand, the same format as the representation shown in FIGS. 5A and 5B is adopted. The waveforms shown in FIG. 8A are waveforms observed on an away side of the write scanner 104, and the waveforms shown in FIG. 8B are waveforms observed on a near side of the write scanner 104. As shown, the scan line potential (i.e., control signal pulse) is not deteriorated on the near side because the wiring resistance and capacitance are small. In contrast, on the rear side, the scan line potential (control signal pulse) is made dull and deteriorated greatly because the wiring resistance and capacitance are large. A pulse deterioration difference is small between the video signal potentials because of the same distance from the horizontal selector 103 as the supply source. Since the waveform deterioration is different on the near and away sides of the screen, there is a difference between the video signal potentials V1 and V2 sampled on the near and away sides. There is also a difference between the mobility correction times t1 and t2 on the away and near sides, respectively. There is a tendency that since the waveform deterioration of the control signal pulse is large on the away side of the screen, the sampling potential V1 becomes large and the mobility correction time t1 becomes long. In contrast, since there is almost no waveform deterioration of the control signal pulse on the near side of the screen, both the sampling potential V2 and mobility correction time t2 take values near the design values. In this way, as the sampling potentials and mobility correction times take different values on the near and away sides of the write scanner in the screen (i.e., right and left sides of the screen), a luminance difference occurs in the right and left sides of the screen, and this difference is visually recognized as shading.

Figure 9:
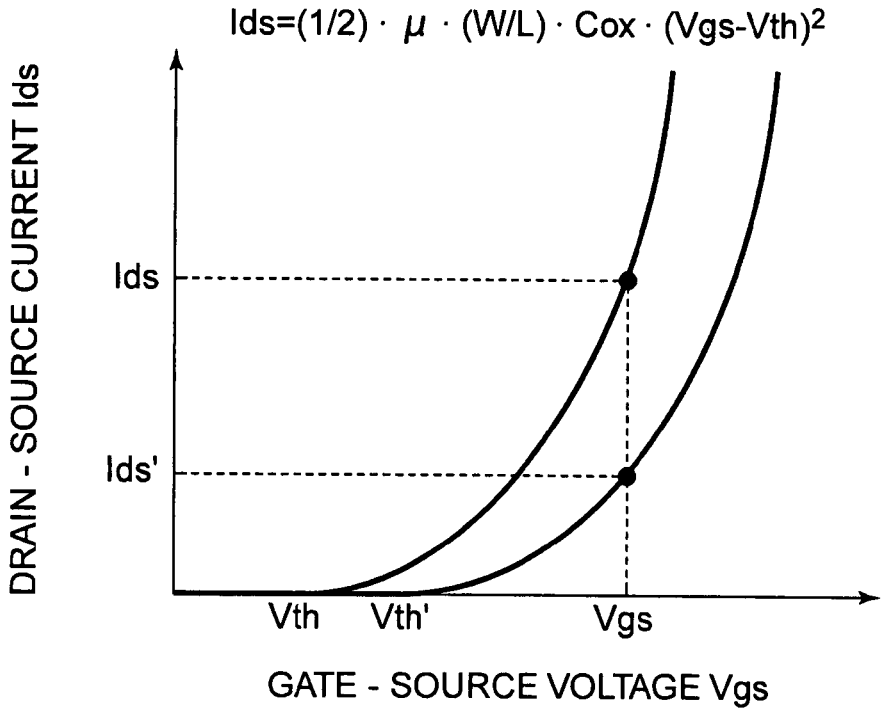
FIG. 9 is a graph showing current-voltage characteristics of a driver transistor.

Lastly, description will further be made on the threshold voltage correction operation, mobility correction operation and bootstrap operation with reference to FIGS. 9 to 11. FIG. 9 is a graph showing the current-voltage characteristics of a driver transistor. A drain-source current Ids particularly when the driver transistor operates in a saturated region is represented by $Ids=(1/2)\cdot\mu\cdot(W/L)\cdot Cox\cdot(Vgs-Vth)^2$, where μ represents a mobility, W represents a gate width, L represents a gate length, and Cox represents a gate oxide film capacitance per unit area. As apparent from this transistor characteristic equation, as the threshold voltage Vth changes, the drain-source current Ids changes even if Vgs is constant. As described earlier, in the pixel of the present invention, the gate-source voltage Vgs is represented by Vin+Vth−ΔV. This is substituted into the transistor characteristic equation. The drain-source current Ids is therefore represented by $Ids=(1/2)\cdot\mu\cdot(W/L)\cdot Cox\cdot(Vin-\Delta V)^2$ and is independent from the threshold voltage Vth. Therefore, even if the threshold voltage varies due to manufacture processes, the drain-source current Ids will not change and an emission luminance of the organic EL device will not change.

If any countermeasure is not taken, as shown in FIG. 9, a drive current is Ids at Vgs when the threshold voltage is Vth, whereas a drive current is Ids' at Vgs when the threshold voltage is Vth', which current is different from Ids.

Figure 10A:
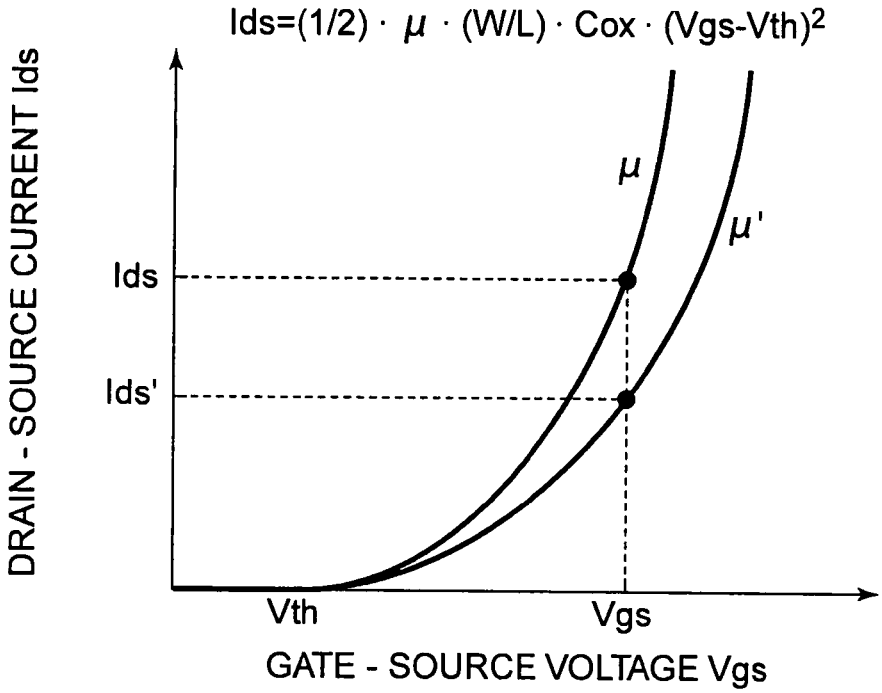
FIG. 10A is a graph showing current-voltage characteristics of the driver transistor.

FIG. 10A is a graph showing the current-voltage characteristics of driver transistors as that of the FIG. 9. Characteristics curves are shown for two driver transistors having different μ and μ'. As seen from the graph, drain-source currents of the driver transistors having different μ and μ', are Ids and Ids' even at the same Vgs.

Figure 10B:
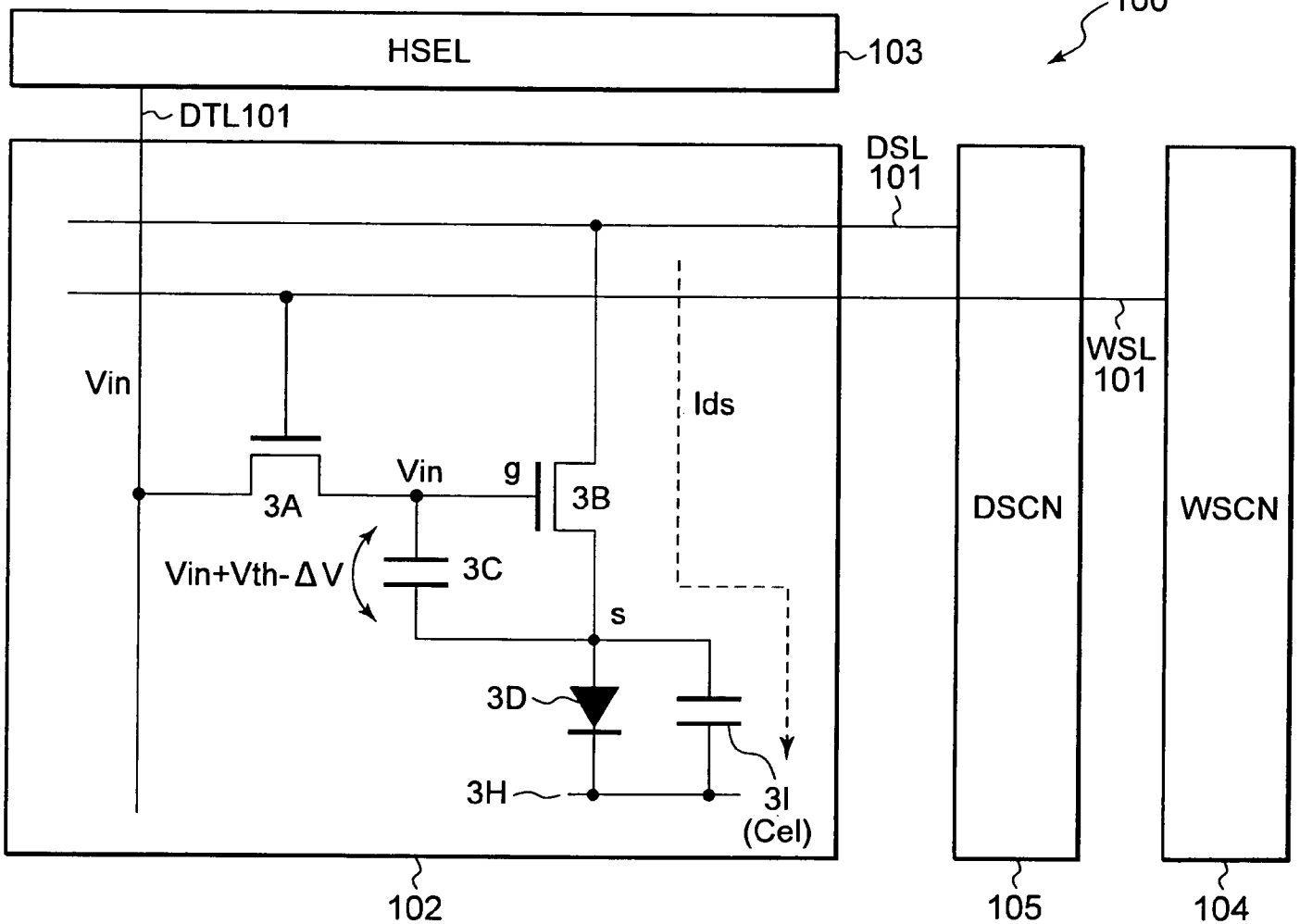
FIG. 10B is a circuit diagram illustrating the operation of a display device of the present invention.

FIG. 10B illustrates the operation of a pixel when a video signal potential is sampled and when a mobility is corrected. In order to make it easy to understand, a parasitic capacitor 3I of a light emitting element 3D is shown. When a video signal potential is sampled, the gate potential Vg of the driver transistor 3B is a video signal potential Vin because the sampling transistor 3A is in the on-state, and a gate-source voltage Vgs of the driver transistor 3B is Vin+Vth. In this case, since the driver transistor 3B is in the on-state and the light emitting element 3D is in the cutoff state, a drain-source current Ids flows into the light emitting element capacitor 3I. As the drain-source current Ids flows into the light emitting element capacitor 3I, the light emitting element capacitor 3I starts charging, and the anode potential of the light emitting element 3D (i.e., the source potential Vs of the driver transistor 3B) starts rising. As the source potential Vs of the driver transistor 3B rises by ΔV, the gate-source voltage Vgs of the driver transistor 3B lowers by ΔV. This corresponds to the mobility correction operation by negative feedback. A reduction amount ΔV of the gate-source voltage Vgs is determined by ΔV=Ids·Cel/t, and ΔV is a parameter for mobility correction. Cel represents a capacitance value of the light emitting element capacitor 3I, and t represents a mobility correction period.

Figure 10C:
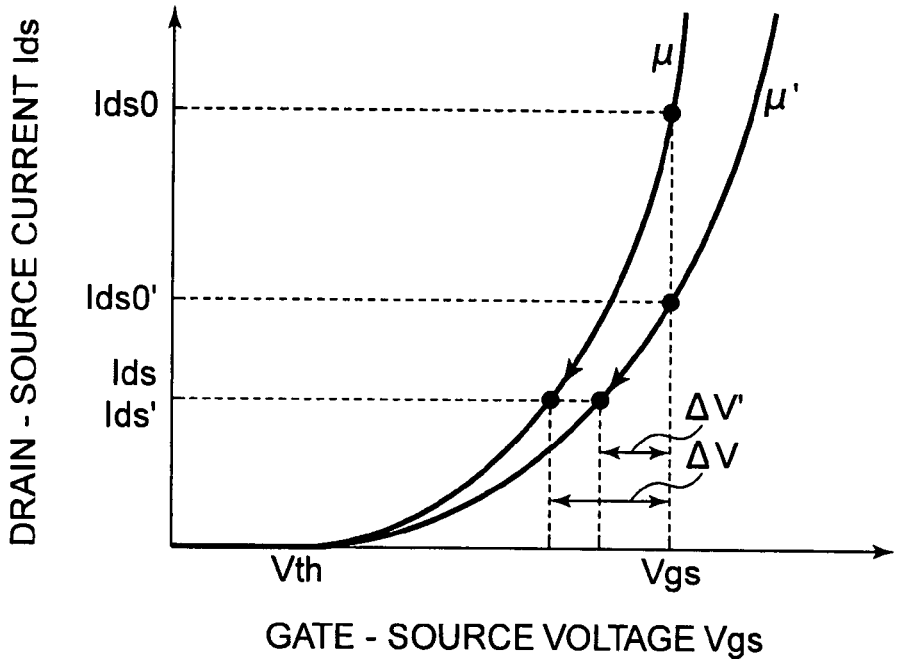
FIG. 10C shows waveforms illustrating the operation of the display device.

FIG. 10C is a graph showing operation points of driver transistors 3B when the mobility is corrected. The above-described mobility correction is conducted relative to a variation in μ and μ' caused by manufacture processes to determine optimum correction parameters ΔV and ΔV' and drain-source currents Ids and Ids' of the driver transistors 3B. If the mobility correction is not conducted, drain-source currents are different Ids0 and Ids0' at the same gate-source voltage Vgs because of different mobilities μ and μ'. In order to avoid this, proper corrections ΔV and ΔV' are given to the mobilities μ and μ' so that the drain-source currents are Ids and Ids' at the same level. As seen from the graph of FIG. 10C, negative feedback is performed in such a manner that the correction amount ΔV becomes large when the mobility μ is high, and the correction amount ΔV' becomes small when the mobility μ' is low.

Figure 11A:
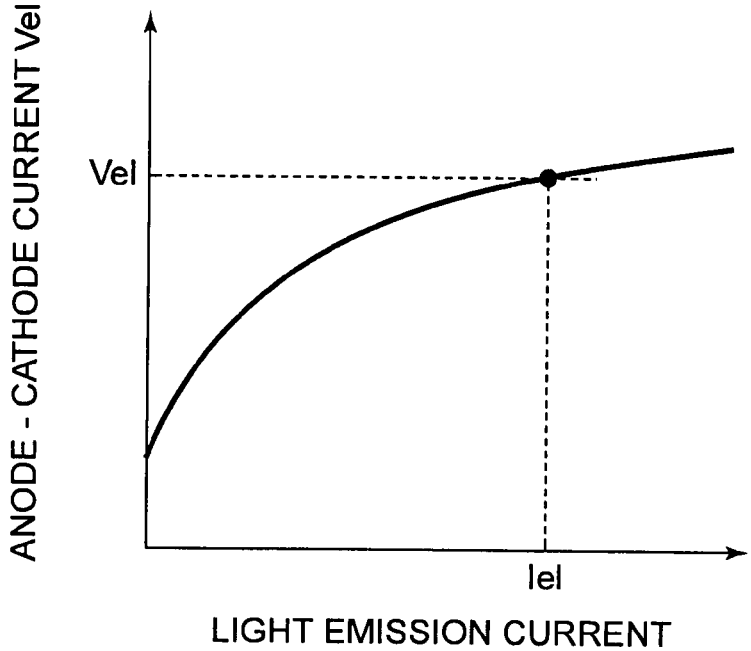
FIG. 11A is a graph showing current-voltage characteristics of a light emitting element.

FIG. 11A is a graph showing current-voltage characteristics of a light emitting element 3D made of an organic EL device. As current Iel flows into the light emitting element 3D, an anode-cathode voltage Vel is determined uniquely. As shown in FIG. 4I, the scan line WSL101 transits to the low potential side during a light emission period, and when the sampling transistor 3A enters the off-state, the anode of the light emitting element 3D rises by the anode-cathode voltage Vel determined by the drain-source current Ids of the driver transistor 3B.

Figure 11B:
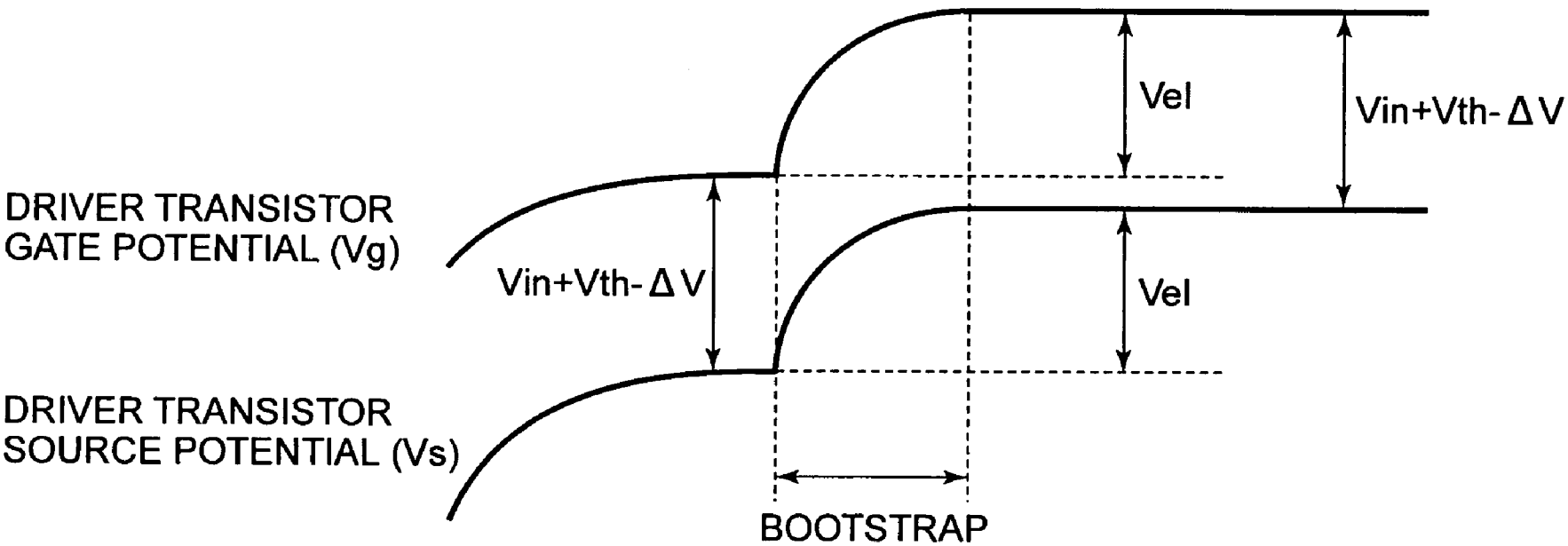
FIG. 11B shows waveforms illustrating a bootstrap operation of a driver transistor.

FIG. 11B is a graph showing a change in the gate potential Vg and source potential Vs of the driver transistor 3B while the anode potential of the light emitting element 3D rises. When the anode potential of the light emitting element 3D rises by Vel, the source of the driver transistor 3B also rises by Vel, and the gate of the driver transistor 3B rises by Vel by the bootstrap operation of the holding capacitor 3C. Therefore, the gate-source voltage Vgs=Vin+Vth−ΔV of the drive transistor 3B held before the bootstrap is maintained even after the bootstrap. Even if the anode potential varies due to secular deterioration of the light emitting element 3D, the gate-source voltage of the driver transistor 3B is always maintained constant at Vin+Vth−ΔV.

Figure 11C:
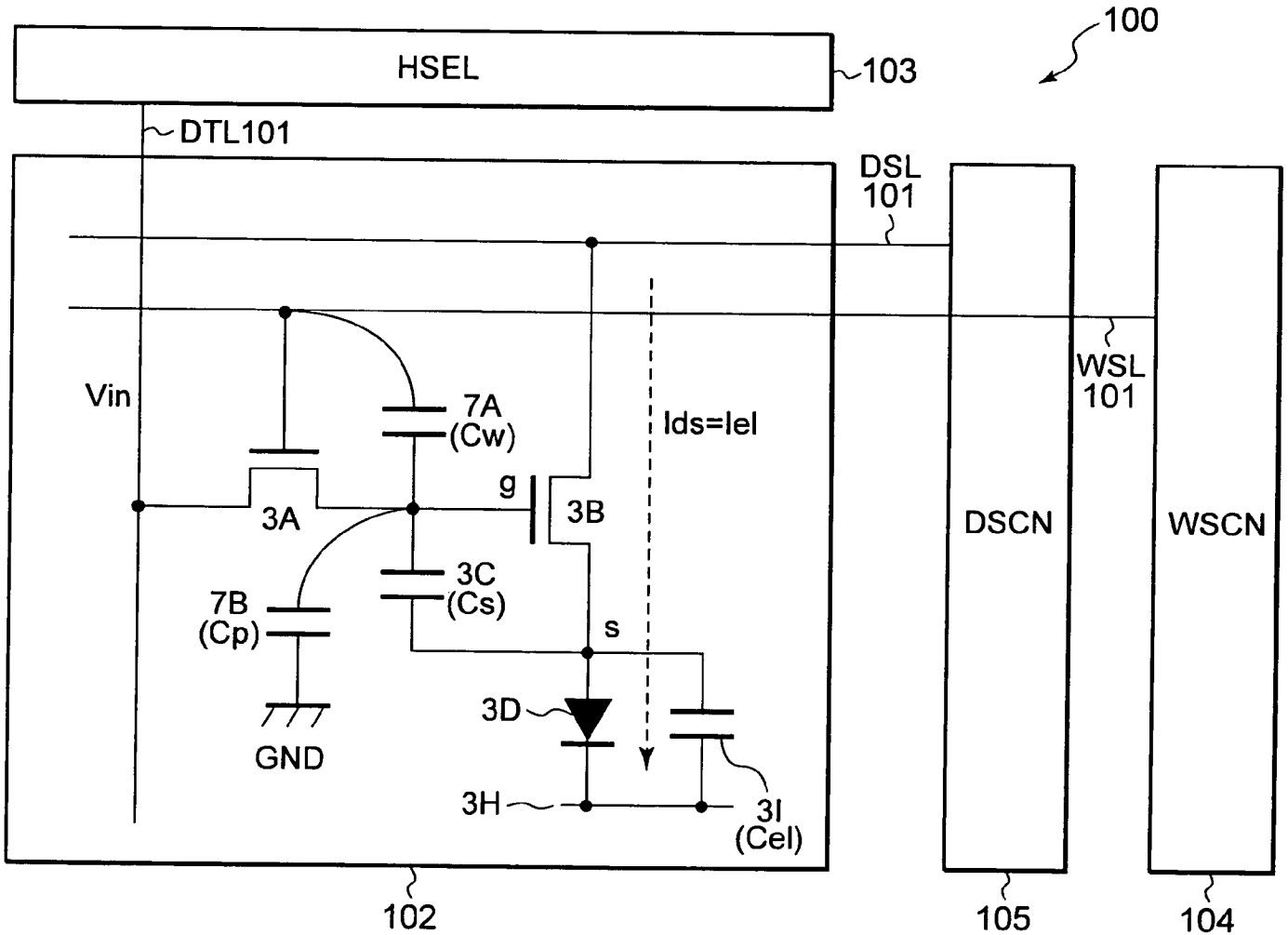
FIG. 11C is a circuit diagram illustrating the operation of a display device of an embodiment of the present invention.

FIG. 11C is a circuit diagram adding parasitic capacitors 7A and 7B to the pixel structure of an embodiment of the present invention described with reference to FIG. 3B. The parasitic capacitors 7A and 7B are parasitic capacitors of the gate g of the driver transistor 3B. The above-described bootstrap ability is represented by Cs/(Cs+Cw+Cp) where Cs is a capacitance value of the holding capacitor, Cw and Cp are capacitance values of the parasitic capacitors 7A and 7B, respectively. If this value is nearer to "1", the bootstrap ability is high. Namely, this indicates a high correction ability relative to secular deterioration of the light emitting element 3D. According to the present invention, the number of components to be connected to the gate g of the driver transistor 3B is minimized so that Cp can almost be neglected. Therefore, the bootstrap ability is represented by Cs/(Cs+Cw) which is unlimitedly near "1", indicating a high correction ability for secular deterioration of the light emitting element 3D.

Figure 12:
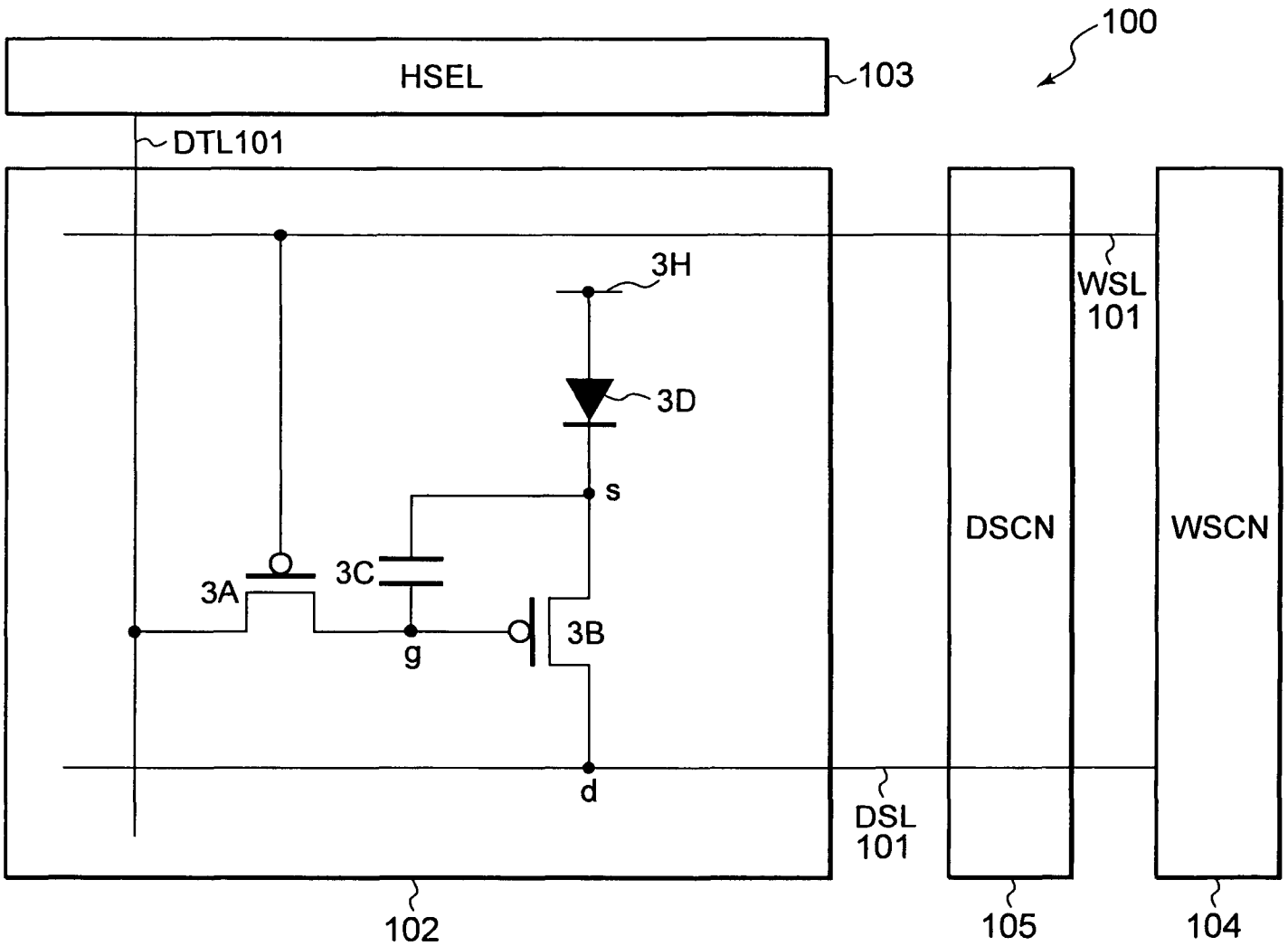
FIG. 12 is a circuit diagram of a display device according another embodiment of the present invention.

FIG. 12 is a schematic circuit diagram showing a display device according to another embodiment of the present invention. In order to make it easy to understand, constituent elements corresponding to those of the embodiment shown in FIG. 3 are represented by corresponding reference numerals in FIG. 12. A different point resides in that the embodiment shown in FIG. 12 forms a pixel circuit by using p-channel transistors, whereas the embodiment shown in FIG. 3B forms a pixel circuit by using n-channel transistors. Quite similar to the pixel circuit shown in FIG. 3B, the pixel circuit shown in FIG. 12 can also execute the threshold voltage correction operation, mobility correction operation and bootstrap operation.

Figure 13:
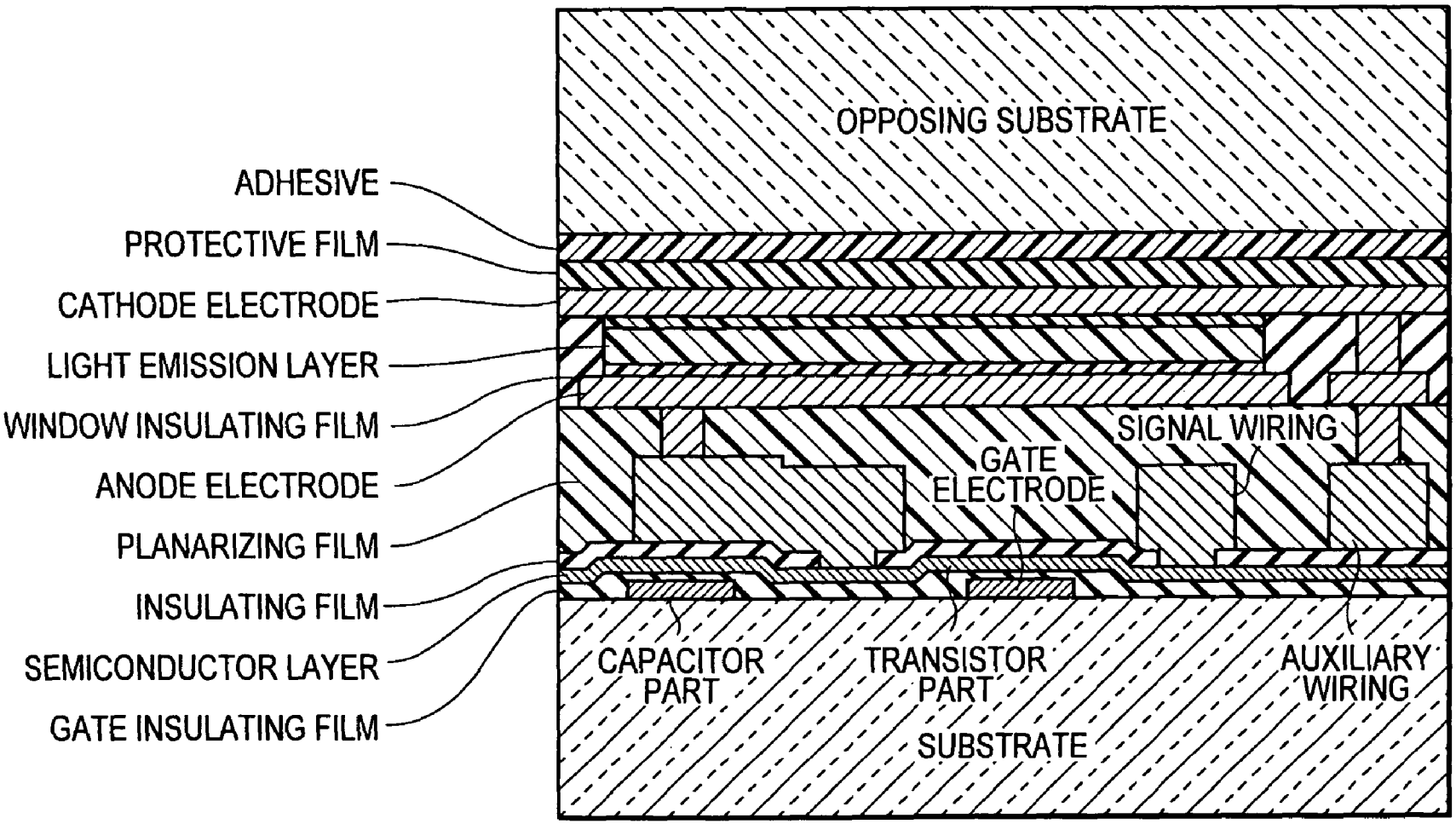
FIG. 13 is a cross sectional view showing the structure of a display device of an embodiment of the present invention.

A display device of an embodiment of the present invention has a thin film device structure such as shown in FIG. 13. FIG. 13 is the schematic cross sectional view showing the structure of a pixel formed on an insulating substrate. As shown, the pixel is constituted of a transistor part including a plurality of thin film transistors (in FIG. 13, one TFT is shown illustratively), a capacitor part such as a holding capacitor and a light emission part such as an organic EL element. The transistor part and capacitor part are formed on the substrate by TFT processes, and the light emission part such as an organic EL element is stacked thereon. A transparent opposing substrate is adhered thereon with adhesive to form a flat panel.

Figure 14:
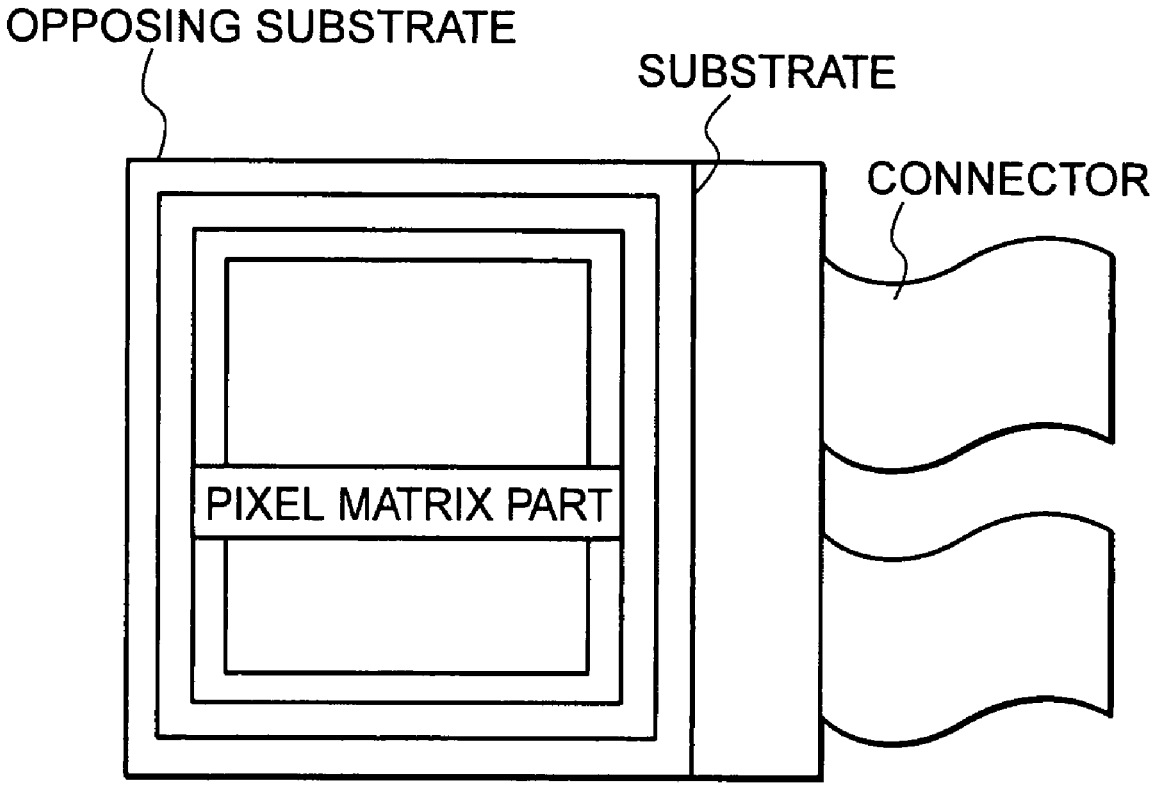
FIG. 14 is a plan view showing the module structure of a display device of an embodiment of the present invention.

A display device of an embodiment of the present invention includes a flat module type such as shown in FIG. 14. For example, a pixel array part (pixel matrix part) is formed by integrating pixels made of organic EL elements, thin film transistors and thin film capacitors in a matrix shape on an insulating substrate, and an opposing substrate made of glass or the like is adhered to the pixel array part (pixel matrix part) by coating adhesive on a peripheral area of the pixel array part to form a display module. If necessary, color filters, protective films, light shielding films may be disposed on the transparent opposing substrate. A flexible print circuit (FPC) may be disposed on the display module as a connector for transferring signals and the like between the external and the pixel array part.

The display device of an embodiment of the present invention described above has a flat panel shape and is applicable to the display of an electronic apparatus in various fields for displaying images or pictures of video signals input to or generated in the electronic apparatus including a digital camera, a note type personal computer, a mobile phone, a video camera and the like. Examples of an electronic apparatus adopting the display of this type will be described.

Figure 15:
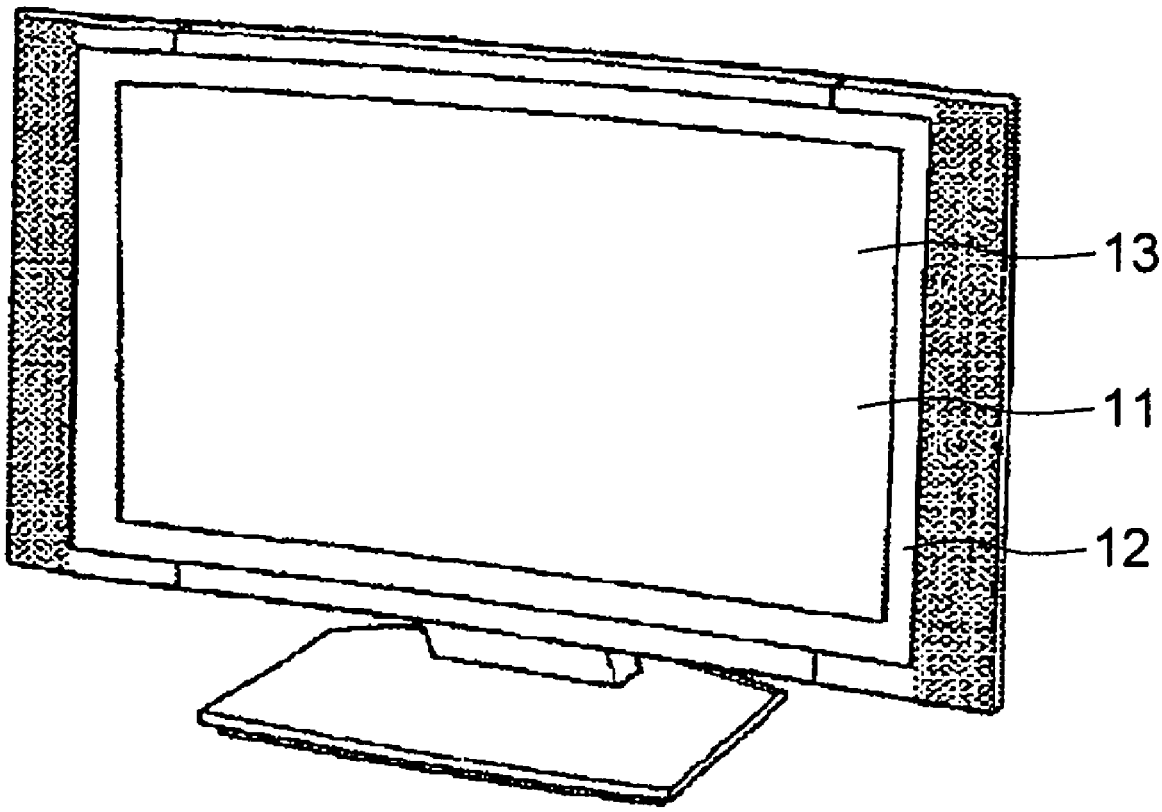
FIG. 15 is a perspective view of a television set equipped with the display device of an embodiment of the present invention.

FIG. 15 shows a television set adopting an embodiment of the present invention. The television set includes a video display screen 11 constituted of a front panel 12, a filter glass 13 and the like, and is manufactured by using the display device of the present invention as the video display screen 11.

Figure 16:
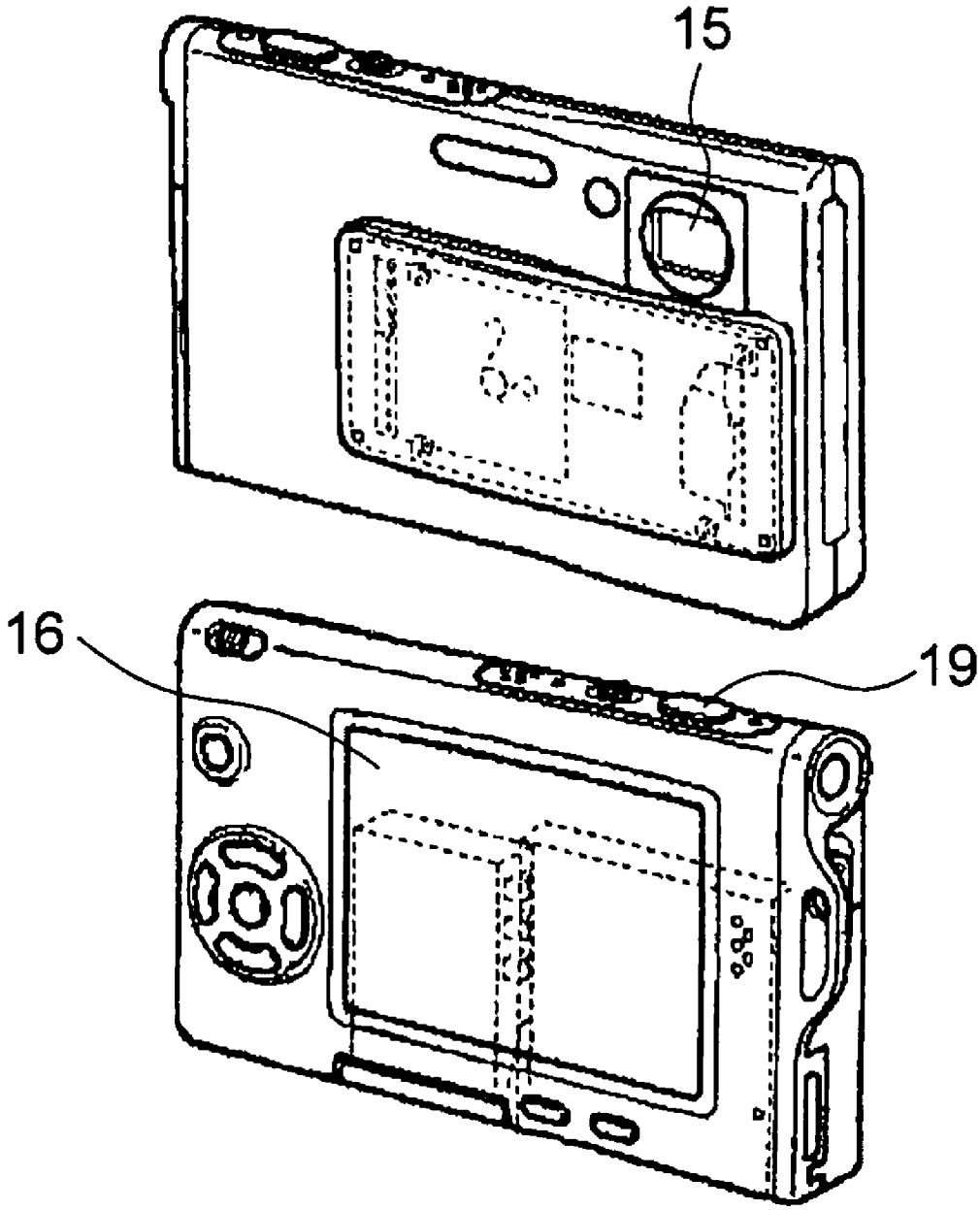
FIG. 16 is a perspective view of a digital still camera equipped with the display device of an embodiment of the present invention.

FIG. 16 shows a digital camera adopting an embodiment of the present invention. The upper is a front view and the lower is a rear view. The digital camera includes a taking lens, a flash emission part 15, a display part 16, control switches, menu switches, a shutter 19 and the like, and is manufactured by using the display device of the present invention as the display part 16.

Figure 17:
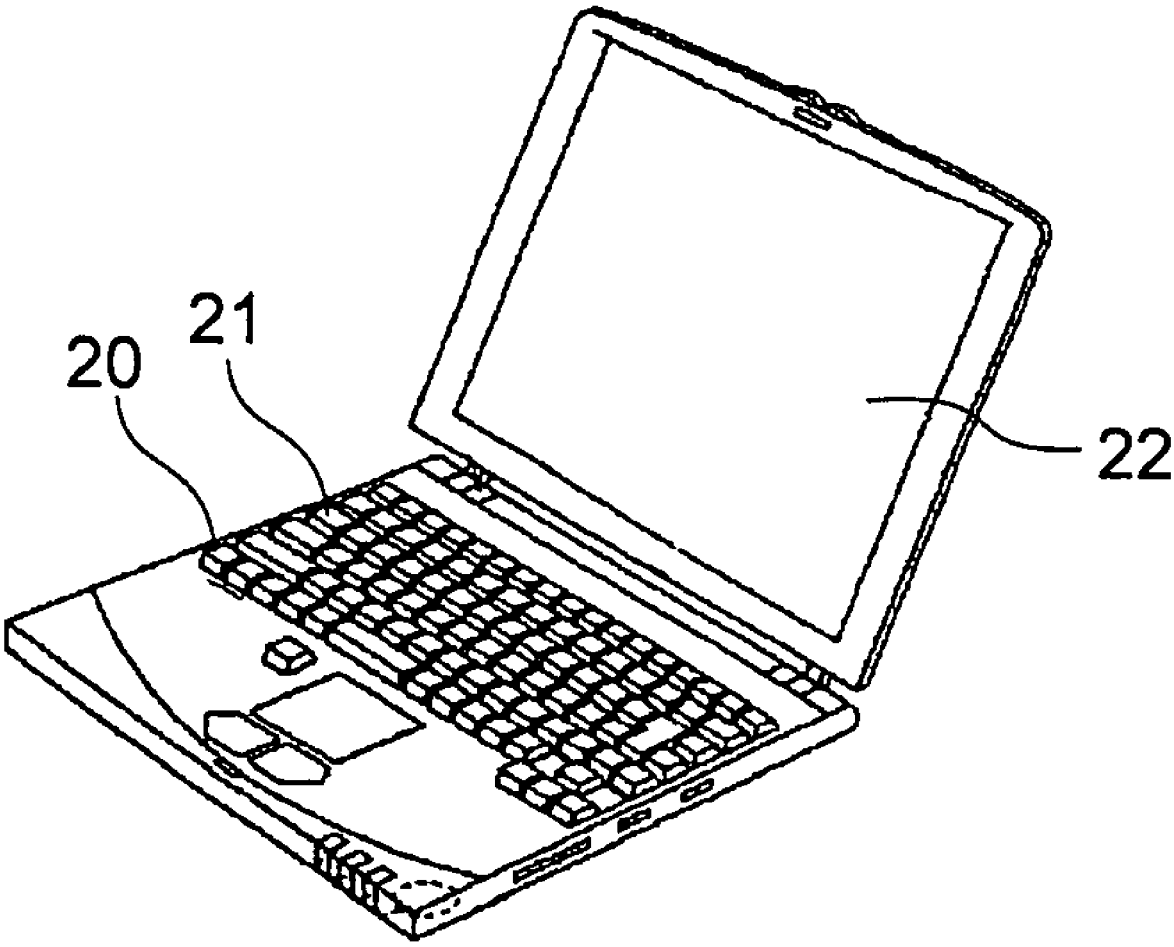
FIG. 17 is a perspective view of a note type personal computer equipped with the display device of an embodiment of the present invention.

FIG. 17 shows a note type personal computer adopting an embodiment of the present invention. A main body 20 includes a keyboard 21 to be operated when characters and the like are input, and a main body cover includes a display part 22 for displaying images. The note type personal computer is manufactured by using the display device of the present invention as the display part 22.

Figure 18:
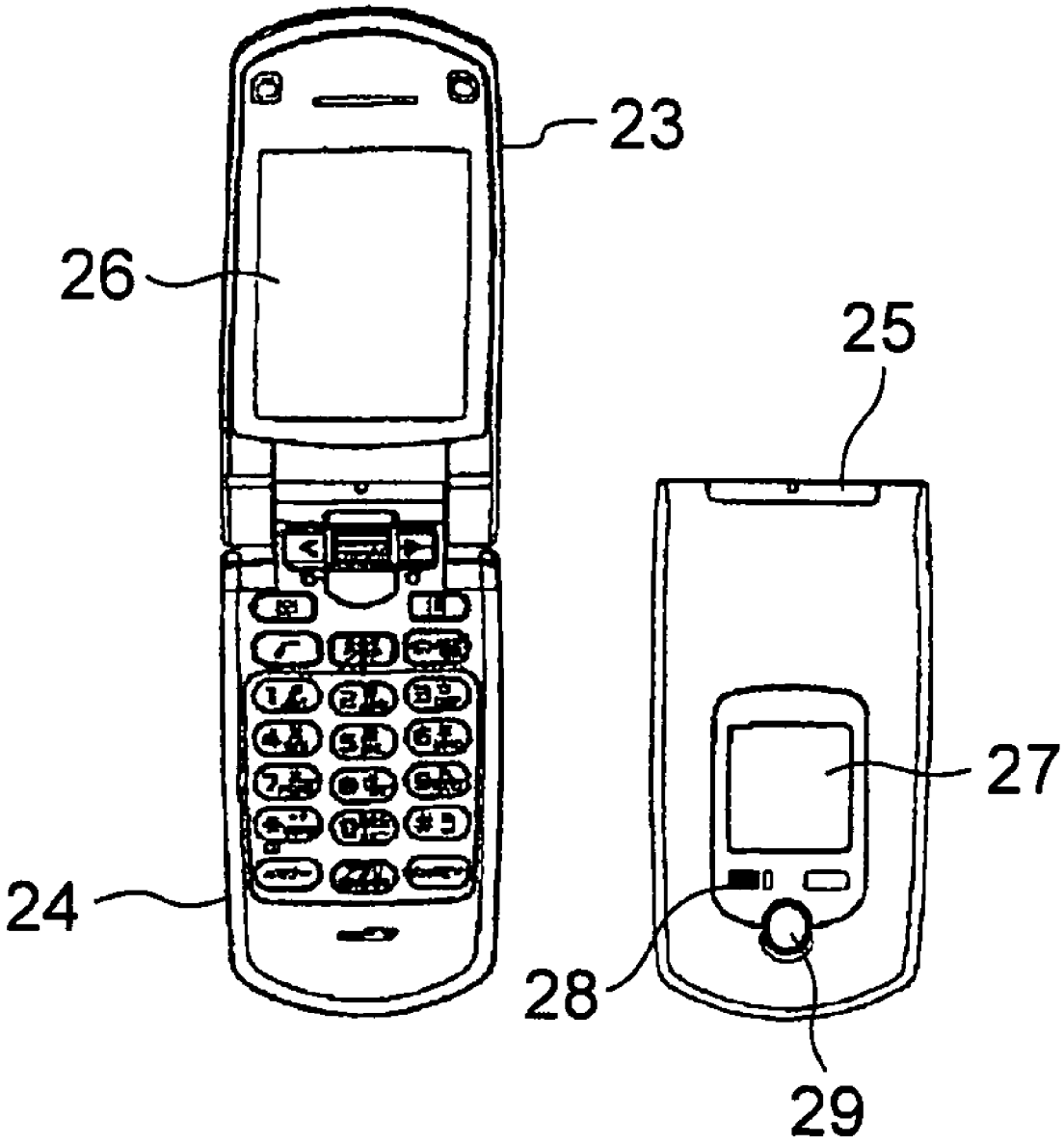
FIG. 18 is a schematic diagram showing a portable terminal apparatus equipped with the display device of an embodiment of the present invention.

FIG. 18 shows a mobile terminal apparatus adopting an embodiment of the present invention. The left shows an open state, and the right shows a close state. The mobile terminal apparatus includes an upper housing 23, a lower housing 24, a coupling part (hinge) 25, a display 26, a sub-display 27, a picture light 28, a camera 29 and the like, and is manufactured by using the display device of the an embodiment of present invention as the display 26 and sub-display 27.

Figure 19:
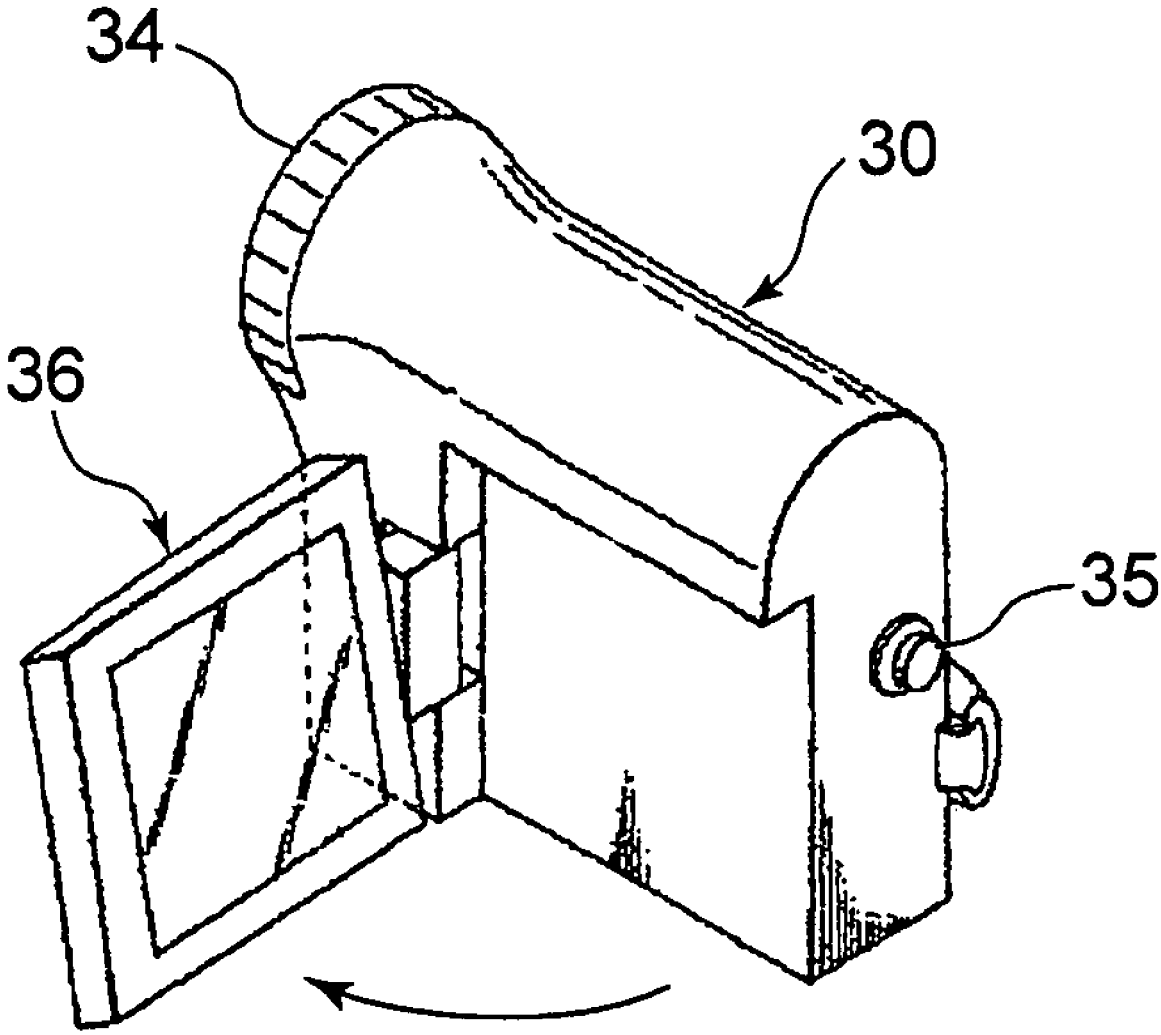
FIG. 19 is a perspective view of a video camera equipped with the display device of an embodiment of the present invention.

FIG. 19 shows a video camera adopting an embodiment of the present invention. The video camera includes a main part 30, an object taking lens 34 disposed on the front side, a photographing start/stop switch 35, a monitor 36 and the like, and is manufactured by using the display device of an embodiment of the present invention as the monitor 36.

It should be understood by those skilled in the art that various modifications, combinations, sub-combinations and alternations may occur depending on design requirements and other factors insofar as they are within the scope of the appended claims or the equivalents thereof.

The present application claims benefit of priority of Japanese patent Application No. 2006-204057 filed in the Japanese Patent Office on Jul. 27, 2006, the entire content of which being incorporated herein by reference.

What is claimed is:

1. A display device comprising:

a pixel array unit including row scan lines, column signal lines, pixels disposed in a matrix shape at cross points between said scan lines and said signal lines, and power supply lines disposed in correspondence of rows of the pixels; and a driver unit for driving the pixel array unit, the driver unit including a main scanner for supplying a sequential control signal to each of the scan lines to perform line sequential scanning of the pixels in a row unit, a power supply scanner for supplying, synchronously with the line sequential scanning, a power supply voltage switching between first and second potentials to each of the power supply lines, and a signal selector for supplying, synchronously with the line sequential scanning, a signal potential as a video signal and a reference potential to each of the column signal lines, wherein each of the pixels includes a light emitting element, a sampling transistor, a driver transistor and a holding capacitor; the sampling transistor having a gate connected to said scan line, one of a source and a drain connected to the signal line, and the other connected to a gate of the driver transistor; the driver transistor having one of a source and a drain connected to the light emitting element, and the other connected to the power supply lines, and the holding capacitor being connected across the source and a gate of the driver transistor, wherein the sampling transistor becomes conductive in response to a control signal, and samples a signal potential and the reference potential supplied from said signal line to hold said sampled signal potential in said holding capacitor, the driver transistor receives a supply of a current from the power supply line at the first potential and flows a drive current to the light emitting element in accordance with the held signal potential, the control signal has a pulse width that is shorter than a time period that the signal line is at the signal potential such that the sampling transistor is conductive within the time period that the signal line is at the signal potential, and such that the sampling transistor becomes conductive after a start of the time period that the signal line is at the signal potential, and wherein the driver transistor receives the supply of the current from the power supply at the first potential while the sampling transistor is conductive to sample the signal potential.

2. The display device according to claim 1, wherein the main scanner makes the sampling transistor non-conductive when the signal potential is held in the holding capacitor to electrically disconnect the signal line from the gate of the driver transistor, thereby making a gate potential of the driver transistor follow a variation in a source potential of the driver transistor to maintain a constant gate-source voltage.

3. The display device according to claim 1, wherein:

the power supply scanner changes said power supply line from said first potential to said second potential at a first timing before said sampling transistor samples said signal potential;

the main scanner makes said sampling transistor conductive at a second timing before said sampling transistor samples said signal potential to apply said reference potential from said signal line to the gate of said driver transistor and set the source of said driver transistor to said second potential; and the power supply scanner changes the power supply line from the second potential to said first potential at a third timing after the second timing to hold a voltage corresponding to a threshold voltage of said driver transistor in the holding capacitor.

4. An electronic apparatus equipped with the display device recited in claim 1.

5. The display device according to claim 1, wherein the pulse width is configured to add to the signal potential a correction for a mobility of the driver transistor when said signal potential is held in the holding capacitor.

6. A driving method for a display device which includes a pixel array unit and a driver unit for driving the pixel array unit, the pixel array unit including row scan lines, column signal lines, pixels disposed in a matrix shape at cross points between the scan lines and the signal lines, and power supply lines disposed in correspondence of rows of the pixels, the driver unit including a main scanner for supplying a sequential control signal to each of the scan lines to perform line sequential scanning of the pixels in a row unit, a power supply scanner for supplying, synchronously with the line sequential scanning, a power supply voltage switching between first and second potentials to each of the power supply lines, and a signal selector for supplying, synchronously with the line sequential scanning, a signal potential as a video signal and a reference potential to each of the column signal lines; wherein:

each of said pixels includes a light emitting element, a sampling transistor, a driver transistor and a holding capacitor;

the sampling transistor has a gate connected to said scan line, one of a source and a drain connected to said signal line, and the other connected to a gate of said driver transistor;

the driver transistor has one of a source and a drain connected to said light emitting element, and the other connected to said power supply lines; and the holding capacitor is connected across the source and a gate of said driver transistor, the method comprising the steps of:

making a conductive state, by the sampling transistor, in response to a control signal supplied from said scan line, and sampling a signal potential and the reference potential supplied from the signal line to hold the sampled signal potential in the holding capacitor;

receiving, by the driver transistor, a supply of a current from the power supply line at the first potential and flows a drive current to the light emitting element in accordance with the held signal potential; and outputting, by the main scanner, the control signal have a pulse width that is shorter than a time period that the signal line is at the signal potential such that the sampling transistor is conductive within the time period that the signal line is at the signal potential, and such that the sampling transistor becomes conductive after a start of the time period that the signal line is at the supply at the first potential while the sampling transistor is conductive to sample the signal potential.

7. The method according to claim 6, wherein the pulse width is configured to add to the signal potential a correction for a mobility of the driver transistor when said signal potential is held in the holding capacitor.

8. A display device comprising:

a pixel array unit including row scan lines, column signal lines, pixels disposed in a matrix shape at cross points between said scan lines and said signal lines, and power supply lines disposed in correspondence of rows of the pixels; and a driver unit for driving the pixel array unit, the driver unit including a main scanner for supplying a sequential control signal to each of the scan lines to perform line sequential scanning of the pixels in a row unit, a power supply scanner for supplying, synchronously with the line sequential scanning, a power supply voltage switching between first and second potentials to each of the power supply lines, and a signal selector for supplying, synchronously with the line sequential scanning, a signal potential as a video signal and a reference potential to each of the column signal lines, wherein each of the pixels includes a light emitting element, a sampling transistor, a driver transistor and a holding capacitor; the sampling transistor having a gate connected to a scan line, one of a source and a drain connected to a signal line, and the other connected to a gate of the driver transistor; the driver transistor having one of a source and a drain connected to the light emitting element, and the other connected to a power supply line, and the holding capacitor being connected across the source and a gate of the driver transistor, wherein the sampling transistor becomes conductive in response to the control signal, and samples the signal potential and the reference potential supplied from said signal line to hold said sampled signal potential in said holding capacitor, the driver transistor receives a supply of a current from the power supply line at the first potential and flows a drive current to the light emitting element in accordance with the held signal potential, the control signal causes the sampling transistor to become conductive during a first time period wherein the signal line is at the reference potential and during a second time period wherein the signal line is at the signal potential, and a pulse width of the control signal that causes the sampling transistor to become conductive during the second time period is shorter than the second time period, and wherein the driver transistor receives the supply of the current from the power supply at the first potential while the sampling transistor is conductive to sample the signal potential.

9. An electronic apparatus equipped with the display device recited in claim 8.

10. The display device according to claim 8, wherein the pulse width is configured to add to the signal potential a correction for a mobility of the driver transistor when said signal potential is held in the holding capacitor.

11. A driving method for a display device which includes a pixel array unit and a driver unit for driving the pixel array unit, the pixel array unit including row scan lines, column signal lines, pixels-disposed in a matrix shape at cross points between the scan lines and the signal lines, and power supply lines disposed in correspondence of rows of the pixels, the driver unit including a main scanner for supplying a sequential control signal to each of the scan lines to perform line sequential scanning of the pixels in a row unit, a power supply scanner for supplying, synchronously with the line sequential scanning, a power supply voltage switching between first and second potentials to each of the power supply lines, and a signal selector for supplying, synchronously with the line sequential scanning, a signal potential as a video signal and a reference potential to each of the column signal lines; wherein:

each of said pixels includes a light emitting element, a sampling transistor, a driver transistor and a holding capacitor;

the sampling transistor has a gate connected to a scan line, one of a source and a drain connected to a signal line, and the other connected to a gate of said driver transistor;

the driver transistor has one of a source and a drain connected to said light emitting element, and the other connected to a power supply line; and the holding capacitor is connected across the source and a gate of said driver transistor, the method comprising the steps of:

making a conductive state, by the sampling transistor, in response to a control signal supplied from said scan line, and sampling the signal potential and the reference potential supplied from the signal line to hold the sampled signal potential in the holding capacitor;

receiving, by the driver transistor, a supply of a current from the power supply line at the first potential and flows a drive current to the light emitting element in accordance with the held signal potential; and outputting, by the main scanner, the control signal so as to cause the sampling transistor to become conductive during a first time period wherein the signal line is at the reference potential and during a second time period wherein the signal line is at the signal potential, wherein a pulse width of the control signal that causes the sampling transistor to become conductive during the second time period is shorter than the second time period, and wherein the driver transistor receives the supply of the current from the power supply at the first potential while the sampling transistor is conductive to sample the signal potential.

12. The method according to claim 11, wherein the pulse width is configured to add to the signal potential a correction for a mobility of the driver transistor when said signal potential is held in the holding capacitor.

* * * * *